US011002460B2

(12) United States Patent
Salsbury et al.

(10) Patent No.: US 11,002,460 B2
(45) Date of Patent: May 11, 2021

(54) BUILDING CONTROL SYSTEM WITH OVERSIZED EQUIPMENT CONTROL AND PERFORMANCE DISPLAY

(71) Applicant: Johnson Controls Technology Company, Auburn Hills, MI (US)

(72) Inventors: Timothy I. Salsbury, Mequon, WI (US); Carlos Felipe Alcala Perez, Milwaukee, WI (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/376,396

(22) Filed: Apr. 5, 2019

(65) Prior Publication Data

US 2020/0318846 A1 Oct. 8, 2020

(51) Int. Cl.

| | |
|---|---|
| ***F24F 11/64*** | (2018.01) |
| ***F24F 11/80*** | (2018.01) |
| ***F24F 11/52*** | (2018.01) |
| ***F24F 110/10*** | (2018.01) |

(52) U.S. Cl.

CPC ..... *F24F 11/64* (2018.01); *F24F 11/52* (2018.01); *F24F 11/80* (2018.01); *F24F 2110/10* (2018.01)

(58) Field of Classification Search

CPC .. F24F 11/64; F24F 11/52; F24F 11/80; F24F 2110/10

See application file for complete search history.

(56) References Cited

U.S. PATENT DOCUMENTS

| | | | | |
|---|---|---|---|---|
| 9,395,708 | B2 | 7/2016 | Perez et al. | |
| 2006/0168972 | A1* | 8/2006 | Fry | 62/157 |
| 2008/0083834 | A1* | 4/2008 | Krebs | F24F 11/30 237/2 A |
| 2012/0259469 | A1* | 10/2012 | Ward | G05B 15/02 700/276 |
| 2016/0097557 | A1* | 4/2016 | Steinberg | H02J 13/0086 700/278 |
| 2016/0169545 | A1* | 6/2016 | Mangsuli | G05B 13/021 700/276 |
| 2016/0282820 | A1 | 9/2016 | Perez et al. | |
| 2016/0282822 | A1 | 9/2016 | Perez et al. | |
| 2017/0023272 | A1* | 1/2017 | Erickson | G05B 15/02 |
| 2018/0252422 | A1 | 9/2018 | Salsbury et al. | |
| 2018/0284735 | A1* | 10/2018 | Cella | H04L 1/0002 |
| 2020/0103130 | A9* | 4/2020 | Imes | F24F 11/62 |

* cited by examiner

*Primary Examiner* — Ziaul Karim
(74) *Attorney, Agent, or Firm* — Foley & Lardner LLP

(57) ABSTRACT

A thermostat for a conditioned space includes a sensor that measures a value of a performance variable of the conditioned space, a user interface that receives a setpoint value from a user and displays information to the user, and a controller. The controller receives values of the performance variable from the sensor over a time period, stores the values of the performance variable, receives the setpoint value from the user interface, and determines a value of a manipulated variable based on the setpoint value and the values of the performance variable. The controller is configured to adjust an operation of HVAC equipment that affect the conditioned space based on the value of the manipulated variable. The controller is configured to determine a smoothed value of the performance variable based on the values of the performance variable and cause the user interface to display the smoothed value.

20 Claims, 9 Drawing Sheets

BUILDING CONTROL SYSTEM WITH OVERSIZED EQUIPMENT CONTROL AND PERFORMANCE DISPLAY

BACKGROUND

The present disclosure relates generally to control systems for an HVAC system. More particularly, the present disclosure relates to a control system configured to reduce displayed temperature swings generated by oversized heating, ventilation, air conditioning (HVAC) control systems.

Many control algorithms for HVAC systems are based on operator established set points and permissible variation about the set points. The range of temperatures between the lowest permissible temperature and the highest permissible temperature is generally referred to as a "deadband." The control algorithm may actuate a cooling system in response to sensing a temperature higher than the highest permissible temperature. The control algorithm may actuate a heating system in response to sensing a temperature lower than the lowest permissible temperature. Many HVAC systems have minimum on/off times to reduce cycling of the HVAC equipment and wear on the HVAC equipment. However, many HVAC systems are oversized for the controlled space. Accordingly, actuation of the cooling system or the heating system may cause the temperature of the controlled space to be outside of the deadband range because, the piece of HVAC equipment must keep operating after the temperature of the controlled space has returned to the deadband range if the piece of HVAC equipment has not yet met the minimum on/off time, which causes the piece of HVAC equipment to overshoot the deadband. Some systems may include an operator interface that displays a temperature of the controlled space to an operator and allows the operator to modify parameters such as temperature set points. In oversized systems, the temperature of the controlled space displayed to the operator may be above or below the temperature set point and/or the deadband range due to the overshoot, which can cause operator frustration.

SUMMARY

One implementation of the present disclosure relates to a thermostat for a conditioned space, according to some embodiments. In some embodiments, the thermostat includes a sensor, a user interface, and a controller. In some embodiments, the thermostat is configured to measure a value of a performance variable of the conditioned space. In some embodiments, the user interface is configured to receive a setpoint value from a user and display information to the user. In some embodiments, the controller is configured to receive one or more values of the performance variable from the sensor over a time period, store the one or more values of the performance variable, receive the setpoint value from the user interface, and determine a value of a manipulated variable based on the setpoint value and the one or more values of the performance variable. In some embodiments, the controller is configured to adjust an operation of HVAC equipment that operate to affect the conditioned space based on the value of the manipulated variable. In some embodiments, the controller is configured to determine a smoothed value of the performance variable based on the one or more values of the performance variable and cause the user interface to display the smoothed value of the performance variable.

In some embodiments, the smoothed value of the performance variable is an average of the one or more values of the performance variable collected over the time period or an exponentially weighted moving average of the one or more values of the performance variable collected over the time period.

In some embodiments, the controller is configured to pass the one or more performance variables from the sensor through a low pass filter to determine the smoothed value of the performance variable.

In some embodiments, the low pass filter has a smoothing value. In some embodiments, the smoothing value is determined based on a time constant of an HVAC system of the thermostat.

In some embodiments, the controller is configured to maintain a current value of the manipulated variable in response to an amount of time since a previous change of the manipulated variable being less than a predetermined threshold.

In some embodiments the user interface is configured to receive a deadband value from the user. In some embodiments, the controller is configured to receive the deadband value from the user interface, and determine the value of the manipulated variable based on the setpoint value, the deadband value, and the one or more values of the performance variable.

Another implementation of the present disclosure is a temperature control system for a conditioned space, according to some embodiments. In some embodiments, the system includes HVAC equipment, a sensor, and a thermostat. In some embodiments, the HVAC equipment operates to affect a temperature of the conditioned space. In some embodiments, the HVAC equipment is configured to operate in an on-state and an off-state. In some embodiments, the sensor is configured to measure a temperature of the conditioned space. In some embodiments, the thermostat is configured to receive and store multiple temperature measurements of the temperature of the conditioned space from the sensor, and determine a smoothed temperature value based on the multiple temperature measurements. In some embodiments, the smoothed temperature value accounts for temporary temperature changes of the conditioned space. In some embodiments, the controller is configured to operate the HVAC equipment in the on-state or the off-state to affect the temperature of the conditioned space based on a temperature setpoint and the temperature of the conditioned space. In some embodiments, the controller is configured to cause a user interface to display the smoothed temperature value.

In some embodiments, the smoothed temperature value is an average of the multiple temperature measurements or an exponentially weighted moving average of the multiple temperature measurements. In some embodiments, the multiple temperature measurements are collected over a previous time interval.

In some embodiments, the thermostat is configured to pass the multiple temperature measurements of the temperature of the conditioned space through a low pass filter to determine the smoothed temperature value.

In some embodiments, the low pass filter has a smoothing factor. In some embodiments, the smoothing factor is determined based on a time constant of the system.

In some embodiments, the thermostat is configured to operate the HVAC equipment in the on-state or the off-state to affect the temperature of the conditioned space based on the temperature setpoint, the temperature of the conditioned space and a deadband value.

In some embodiments, the thermostat is configured to maintain a current operational state of the HVAC equipment in response to an amount of time since a previous operational state change of the HVAC equipment being less than a predetermined threshold.

Another implementation of the present disclosure is a method for adjusting an operation of HVAC equipment and determining a smoothed performance variable value, according to some embodiments. In some embodiments, the method includes receiving a setpoint value of a performance variable of a conditioned space, measuring one or more values of the performance variable of the conditioned space, and determining a value of a manipulated variable based on the one or more measured values of the performance variable and the setpoint value. In some embodiments, the method includes transitioning the HVAC equipment between an on state and an off state based on the value of the manipulated variable. In some embodiments, the method includes determining a smoothed value of the performance variable based on the one or more values of the performance variable, and displaying the smoothed value of the performance variable to a user.

In some embodiments, the smoothed value mitigates an effect of a size of the HVAC equipment with respect to a size of the conditioned space.

In some embodiments, determining the smoothed value further includes determining an average or an exponentially weighted moving average of multiple values of the performance variable of the conditioned space.

In some embodiments, the multiple values of the performance variable of the conditioned space are sampled at multiple times.

In some embodiments, the method further includes receiving a deadband value of the performance variable of the conditioned space, and determining the value of the manipulated variable based on the one or more measured values of the performance variable, the setpoint value, and the deadband value.

In some embodiments, determining the smoothed value further includes passing the one or more values of the performance variable through a low pass filter.

In some embodiments, the low pass filter includes a smoothing factor.

In some embodiments, the smoothing factor is configured to smooth the one or more values of the performance variable such that the smoothed value of the performance variable does not exceed a maximum deadband value. In some embodiments, the maximum deadband value is determined based on the setpoint value and the deadband value.

DETAILED DESCRIPTION

Overview

Referring generally to the FIGURES, a system for controlling HVAC equipment and providing a smoothed performance variable value at a user interface are shown, according to some embodiments. In some embodiments, the system includes a controller or a thermostat, HVAC equipment, a conditioned space, and a sensor. The controller or the thermostat may be positioned locally within the conditioned space, or may be positioned remotely, according to some embodiments. In some embodiments, the controller/thermostat is located remotely from the conditioned space but is configured to receive temperature information from the sensor and control a user interface to display the smoothed performance variable. The controller and/or the thermostat is configured to receive the temperature readings from the temperature sensor and use a deadband filter and an on/off controller to determine whether the HVAC equipment should operate in an on-state or an off-state to affect the temperature of the conditioned space, according to some embodiments. In some embodiments, the controller and/or the thermostat smooth the temperature readings received from the sensor and provide the smoothed values to a user via the user interface. In some embodiments, the controller and/or the thermostat average multiple values of the performance variable collected by the sensor at multiple times. In some embodiments, the controller and/or the thermostat determine an exponentially weighted moving average of the multiple values of the performance variable collected by the sensor at multiple times. In some embodiments, the controller and/or the thermostat determine the smoothed value by passing the values of the performance variable as measured by the sensor through a low-pass filter. In some embodiments, the low-pass filter includes a smoothing factor. In some embodiments, the smoothing factor is set based on a time constant of the system. In some embodiments, the smoothing factor is selected such that the smoothed value of the performance variable does not deviate outside of maximum and minimum deadband values. Advantageously, displaying the smoothed value of the performance variable as opposed to displaying the performance variable itself reduces the likelihood that a user will unnecessarily adjust the setpoint of the thermostat/controller.

HVAC System

Figure 1:
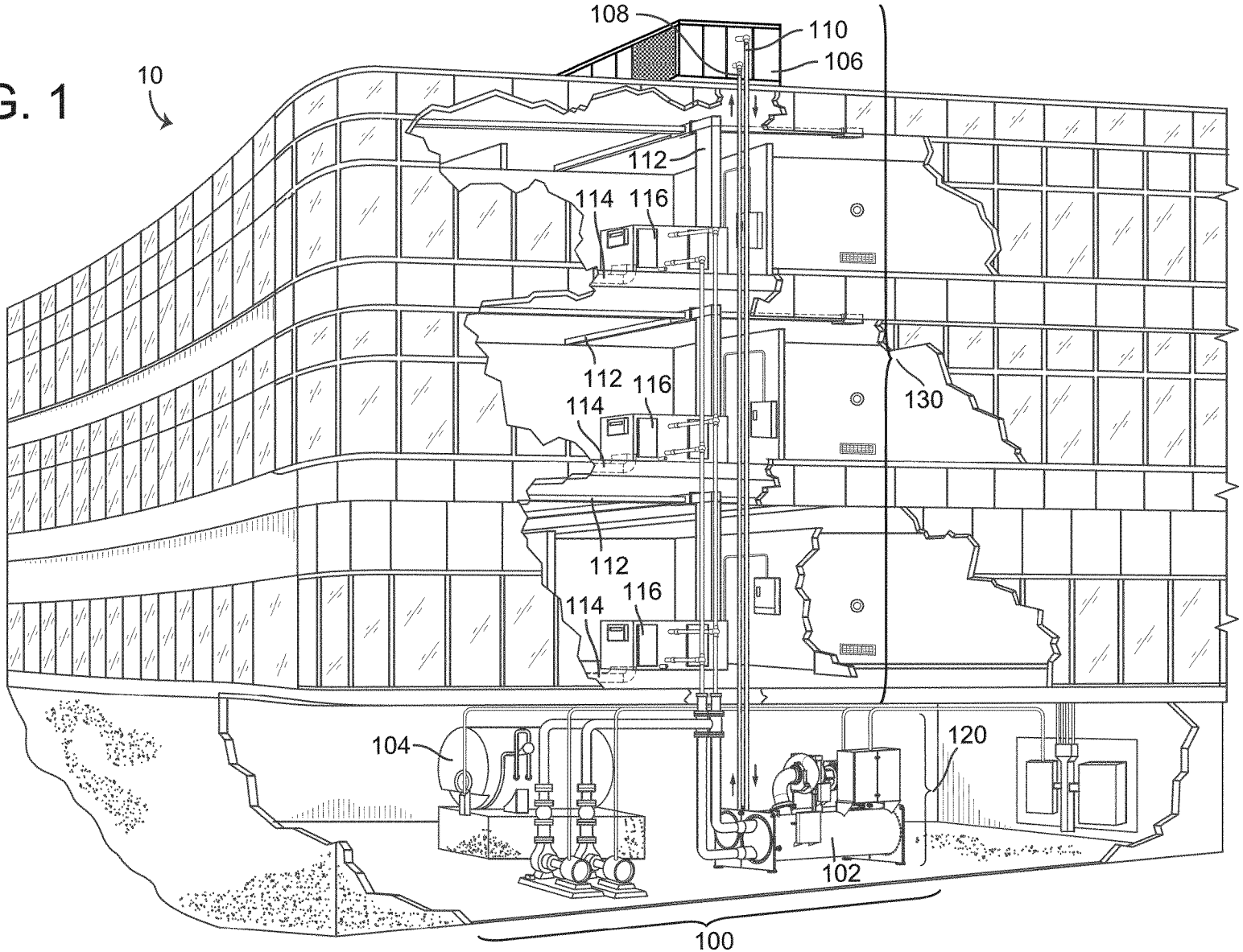
FIG. 1 is a drawing of a building equipped with an HVAC system, according to some embodiments.
Figure 2:
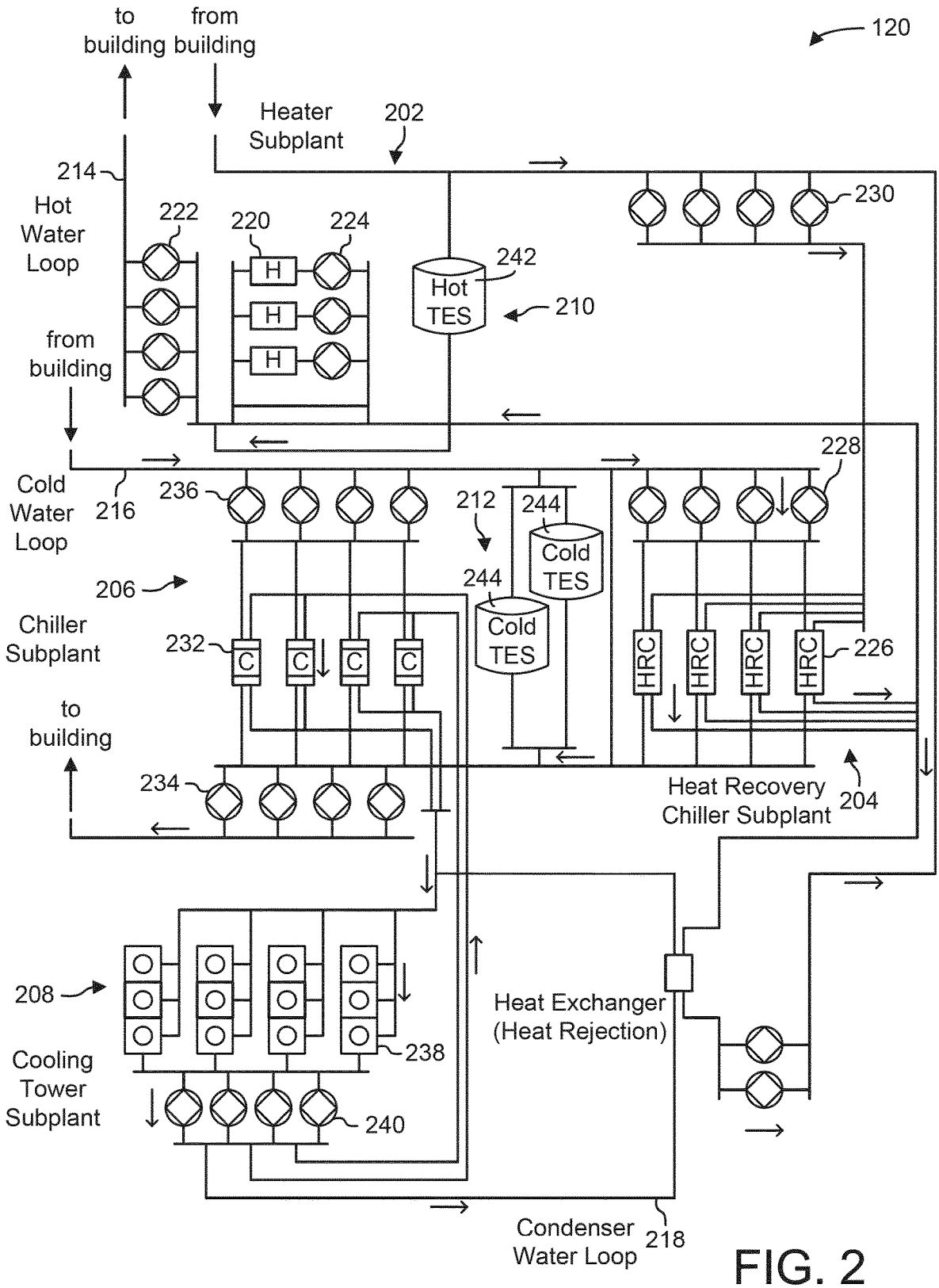
FIG. 2 is a schematic of a waterside system which can be used as part of the HVAC system of FIG. 1, according to some embodiments.
Figure 3:
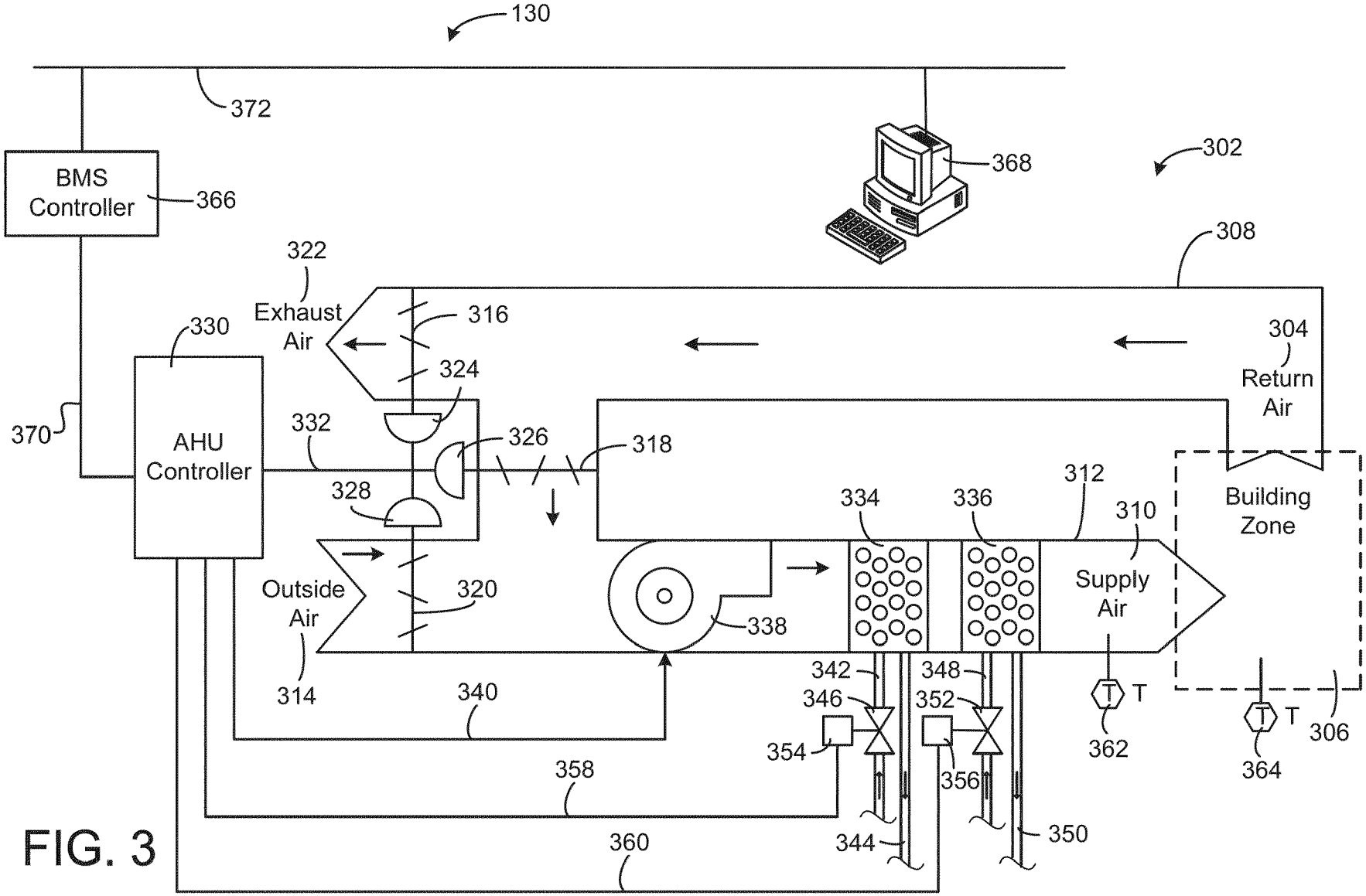
FIG. 3 is a block diagram illustrating an airside system which can be used as part of the HVAC system of FIG. 1, according to some embodiments.

Referring now to FIGS. 1-3, an exemplary HVAC system in which the systems and methods of the present disclosure can be implemented are shown, according to an exemplary embodiment. While the systems and methods of the present disclosure are described primarily in the context of a building HVAC system, it should be understood that the control strategies described herein may be generally applicable to any type of control system that optimizes or regulates a variable of interest. For example, the systems and methods herein may be used to optimize an amount of energy produced by various types of energy producing systems or devices (e.g., power plants, steam or wind turbines, solar panels, combustion systems, etc.) and/or to optimize an amount of energy consumed by various types of energy consuming systems or devices (e.g., electronic circuitry, mechanical equipment, aerospace and land-based vehicles, building equipment, HVAC devices, refrigeration systems, etc.).

In various implementations, such control strategies may be used in any type of controller that functions to achieve a setpoint for a variable of interest (e.g., by minimizing a difference between a measured or calculated input and a setpoint) and/or optimize a variable of interest (e.g., maximize or minimize an output variable). It is contemplated that these control strategies can be readily implemented in various types of controllers (e.g., motor controllers, power controllers, fluid controllers, HVAC controllers, lighting controllers, chemical controllers, process controllers, etc.) and various types of control systems (e.g., closed-loop control systems, open-loop control systems, feedback control systems, feed-forward control systems, etc.) as may be suitable for various applications. All such implementations should be considered within the scope of the present disclosure.

Referring particularly to FIG. 1, a perspective view of a building 10 is shown. Building 10 may generally include a building management system (e.g., a system of devices configured to control, monitor, and manage equipment in or around building 10). The building management system can include, for example, a HVAC system, a security system, a lighting system, a fire alerting system, any other system that is capable of managing building functions or devices, or any combination thereof.

Building 10 is served by an HVAC system 100. HVAC system 100 can include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 can provide a heated or chilled fluid to an air handling unit of airside system 130. Airside system 130 can use the heated or chilled fluid to heat or cool an airflow provided to building 10.

HVAC system 100 is shown to include a chiller 102, a boiler 104, and a rooftop air handling unit (AHU) 106. Waterside system 120 can use boiler 104 and chiller 102 to heat or cool a working fluid (e.g., water, glycol, etc.) and can circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 can add heat to the circulated fluid, for example, by burning a combustible material (e.g., natural gas) or using an electric heating element. Chiller 102 can place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 can place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 can transfer heat between the airflow and the working fluid to provide heating or cooling for the airflow. For example, AHU 106 can include one or more fans or blowers configured to pass the airflow over or through a heat exchanger containing the working fluid. The working fluid can then return to chiller 102 or boiler 104 via piping 110.

Airside system 130 can deliver the airflow supplied by AHU 106 (i.e., the supply airflow) to building 10 via air supply ducts 112 and can provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 can receive input from sensors located within AHU 106 and/or within the building zone and can adjust the flow rate, temperature, or other attributes of the supply airflow through AHU 106 to achieve set-point conditions for the building zone.

Referring now to FIG. 2, a block diagram of waterside system 120 is shown, according to an exemplary embodiment. Waterside system 120 can include a subset of the HVAC devices in HVAC system 100 (e.g., boiler 104, chiller 102, pumps, valves, etc.) and can operate to supply a heated or chilled fluid to AHU 106. The HVAC devices of waterside system 120 can be located within building 10 (e.g., as components of waterside system 120) or at an offsite location such as a central plant.

In FIG. 2, waterside system 120 is shown as a central plant having a plurality of subplants 202-212. Subplants 202-212 are shown to include a heater subplant 202, a heat recovery chiller subplant 204, a chiller subplant 206, a cooling tower subplant 208, a hot thermal energy storage (TES) subplant 210, and a cold thermal energy storage (TES) subplant 212. Subplants 202-212 consume resources (e.g., water, natural gas, electricity, etc.) from utilities to serve the thermal energy loads (e.g., hot water, cold water, heating, cooling, etc.) of a building or campus. For example, heater subplant 202 can be configured to heat water in a hot water loop 214 that circulates the hot water between heater subplant 202 and building 10. Chiller subplant 206 can be configured to chill water in a cold water loop 216 that circulates the cold water between chiller subplant 206 and the building 10. Heat recovery chiller subplant 204 can be configured to transfer heat from cold water loop 216 to hot water loop 214 to provide additional heating for the hot water and additional cooling for the cold water. Condenser water loop 218 can absorb heat from the cold water in chiller subplant 206 and reject the absorbed heat in cooling tower subplant 208 or transfer the absorbed heat to hot water loop 214. Hot TES subplant 210 and cold TES subplant 212 can store hot and cold thermal energy, respectively, for subsequent use.

Hot water loop 214 and cold water loop 216 can deliver the heated and/or chilled water to air handlers located on the rooftop of building 10 (e.g., AHU 106) or to individual floors or zones of building 10 (e.g., VAV units 116). The air handlers push air past heat exchangers (e.g., heating coils or cooling coils) through which the water flows to provide heating or cooling for the air. The heated or cooled air can be delivered to individual zones of building 10 to serve the thermal energy loads of building 10. The water then returns to subplants 202-212 to receive further heating or cooling.

Although subplants 202-212 are shown and described as heating and cooling water for circulation to a building, it is understood that any other type of working fluid (e.g., glycol, CO2, etc.) can be used in place of or in addition to water to serve the thermal energy loads. In other embodiments, subplants 202-212 can provide heating and/or cooling directly to the building or campus without requiring an intermediate heat transfer fluid. These and other variations to waterside system 120 are within the scope of the present invention.

Each of subplants 202-212 can include a variety of equipment configured to facilitate the functions of the subplant. For example, heater subplant 202 is shown to include a plurality of heating elements 220 (e.g., boilers, electric heaters, etc.) configured to add heat to the hot water in hot water loop 214. Heater subplant 202 is also shown to include several pumps 222 and 224 configured to circulate the hot water in hot water loop 214 and to control the flow rate of the hot water through individual heating elements 220. Chiller subplant 206 is shown to include a plurality of chillers 232 configured to remove heat from the cold water in cold water loop 216. Chiller subplant 206 is also shown to include several pumps 234 and 236 configured to circulate the cold water in cold water loop 216 and to control the flow rate of the cold water through individual chillers 232.

Heat recovery chiller subplant 204 is shown to include a plurality of heat recovery heat exchangers 226 (e.g., refrigeration circuits) configured to transfer heat from cold water loop 216 to hot water loop 214. Heat recovery chiller subplant 204 is also shown to include several pumps 228 and 230 configured to circulate the hot water and/or cold water through heat recovery heat exchangers 226 and to control the flow rate of the water through individual heat recovery heat exchangers 226. Cooling tower subplant 208 is shown to include a plurality of cooling towers 238 configured to remove heat from the condenser water in condenser water loop 218. Cooling tower subplant 208 is also shown to include several pumps 240 configured to circulate the condenser water in condenser water loop 218 and to control the flow rate of the condenser water through individual cooling towers 238.

Hot TES subplant 210 is shown to include a hot TES tank 242 configured to store the hot water for later use. Hot TES subplant 210 can also include one or more pumps or valves configured to control the flow rate of the hot water into or out of hot TES tank 242. Cold TES subplant 212 is shown to include cold TES tanks 244 configured to store the cold water for later use. Cold TES subplant 212 can also include one or more pumps or valves configured to control the flow rate of the cold water into or out of cold TES tanks 244.

In some embodiments, one or more of the pumps in waterside system 120 (e.g., pumps 222, 224, 228, 230, 234, 236, and/or 240) or pipelines in waterside system 120 include an isolation valve associated therewith. Isolation valves can be integrated with the pumps or positioned upstream or downstream of the pumps to control the fluid flows in waterside system 120. In various embodiments, waterside system 120 can include more, fewer, or different types of devices and/or subplants based on the particular configuration of waterside system 120 and the types of loads served by waterside system 120.

Referring now to FIG. 3, a block diagram of an airside system 130 is shown, according to an exemplary embodiment. Airside system 130 can include a subset of the HVAC devices in HVAC system 100 (e.g., AHU 106, VAV units 116, ducts 112-114, fans, dampers, etc.) and can be located in or around building 10. Airside system 130 can operate to heat or cool an airflow provided to building 10 using a heated or chilled fluid provided by waterside system 120.

In FIG. 3, airside system 130 is shown to include an economizer-type air handling unit (AHU) 302. Economizer-type AHUs vary the amount of outside air and return air used by the air handling unit for heating or cooling. For example, AHU 302 can receive return air 304 from building zone 306 via return air duct 308 and can deliver supply air 310 to building zone 306 via supply air duct 312. In some embodiments, AHU 302 is a rooftop unit located on the roof of building 10 (e.g., AHU 106 as shown in FIG. 1) or otherwise positioned to receive return air 304 and outside air 314. AHU 302 can be configured to operate an exhaust air damper 316, mixing damper 318, and outside air damper 320 to control an amount of outside air 314 and return air 304 that combine to form supply air 310. Any return air 304 that does not pass through mixing damper 318 can be exhausted from AHU 302 through exhaust damper 316 as exhaust air 322.

Each of dampers 316-320 can be operated by an actuator. For example, exhaust air damper 316 can be operated by actuator 324, mixing damper 318 can be operated by actuator 326, and outside air damper 320 can be operated by actuator 328. Actuators 324-328 can communicate with an AHU controller 330 via a communications link 332. Actuators 324-328 can receive control signals from AHU controller 330 and can provide feedback signals to AHU controller 330. Feedback signals can include, for example, an indication of a current actuator or damper position, an amount of torque or force exerted by the actuator, diagnostic information (e.g., results of diagnostic tests performed by actuators 324-328), status information, commissioning information, configuration settings, calibration data, and/or other types of information or data that can be collected, stored, or used by actuators 324-328. AHU controller 330 can be an economizer controller configured to use one or more control algorithms (e.g., state-based algorithms, extremum-seeking control (ESC) algorithms, proportional-integral (PI) control algorithms, proportional-integral-derivative (PID) control algorithms, model predictive control (MPC) algorithms, feedback control algorithms, etc.) to control actuators 324-328.

Still referring to FIG. 3, AHU 302 is shown to include a cooling coil 334, a heating coil 336, and a fan 338 positioned within supply air duct 312. Fan 338 can be configured to force supply air 310 through cooling coil 334 and/or heating coil 336 and provide supply air 310 to building zone 306. AHU controller 330 can communicate with fan 338 via communications link 340 to control a flow rate of supply air 310. In some embodiments, AHU controller 330 controls an amount of heating or cooling applied to supply air 310 by modulating a speed of fan 338.

Cooling coil 334 can receive a chilled fluid from waterside system 120 (e.g., from cold water loop 216) via piping 342 and can return the chilled fluid to waterside system 120 via piping 344. Valve 346 can be positioned along piping 342 or piping 344 to control a flow rate of the chilled fluid through cooling coil 334. In some embodiments, cooling coil 334 includes multiple stages of cooling coils that can be independently activated and deactivated (e.g., by AHU controller 330, by BMS controller 366, etc.) to modulate an amount of cooling applied to supply air 310.

Heating coil 336 can receive a heated fluid from waterside system 120 (e.g., from hot water loop 214) via piping 348 and can return the heated fluid to waterside system 120 via piping 350. Valve 352 can be positioned along piping 348 or piping 350 to control a flow rate of the heated fluid through heating coil 336. In some embodiments, heating coil 336 includes multiple stages of heating coils that can be independently activated and deactivated (e.g., by AHU controller 330, by BMS controller 366, etc.) to modulate an amount of heating applied to supply air 310.

Each of valves 346 and 352 can be controlled by an actuator. For example, valve 346 can be controlled by actuator 354 and valve 352 can be controlled by actuator 356. Actuators 354-356 can communicate with AHU controller 330 via communications links 358-360. Actuators 354-356 can receive control signals from AHU controller 330 and can provide feedback signals to controller 330. In some embodiments, AHU controller 330 receives a measurement of the supply air temperature from a temperature sensor 362 positioned in supply air duct 312 (e.g., downstream of cooling coil 334 and/or heating coil 336). AHU controller 330 can also receive a measurement of the temperature of building zone 306 from a temperature sensor 364 located in building zone 306.

In some embodiments, AHU controller 330 operates valves 346 and 352 via actuators 354-356 to modulate an amount of heating or cooling provided to supply air 310 (e.g., to achieve a set-point temperature for supply air 310 or to maintain the temperature of supply air 310 within a set-point temperature range). The positions of valves 346 and 352 affect the amount of heating or cooling provided to supply air 310 by cooling coil 334 or heating coil 336 and may correlate with the amount of energy consumed to achieve a desired supply air temperature. AHU controller 330 can control the temperature of supply air 310 and/or building zone 306 by activating or deactivating coils 334-336, adjusting a speed of fan 338, or a combination thereof.

Still referring to FIG. 3, airside system 130 is shown to include a BMS controller 366 and a client device 368. BMS controller 366 can include one or more computer systems (e.g., servers, supervisory controllers, subsystem controllers, etc.) that serve as system level controllers, application or data servers, head nodes, or master controllers for airside system 130, waterside system 120, HVAC system 100, and/or other controllable systems that serve building 10. BMS controller 366 can communicate with multiple downstream building systems or subsystems (e.g., HVAC system 100, a security system, a lighting system, waterside system 120, etc.) via a communications link 370 according to like or disparate protocols (e.g., LON, BACnet, etc.). In various embodiments, AHU controller 330 and BMS controller 366 can be separate (as shown in FIG. 3) or integrated. In an integrated implementation, AHU controller 330 can be a software module configured for execution by a processor of BMS controller 366.

In some embodiments, AHU controller 330 receives information from BMS controller 366 (e.g., commands, setpoints, operating boundaries, etc.) and provides information to BMS controller 366 (e.g., temperature measurements, valve or actuator positions, operating statuses, diagnostics, etc.). For example, AHU controller 330 can provide BMS controller 366 with temperature measurements from temperature sensors 362-364, equipment on/off states, equipment operating capacities, and/or any other information that can be used by BMS controller 366 to monitor or control a variable state or condition within building zone 306.

Client device 368 can include one or more human-machine interfaces or client interfaces (e.g., graphical operator interfaces, reporting interfaces, text-based computer interfaces, client-facing web services, web servers that provide pages to web clients, etc.) for controlling, viewing, or otherwise interacting with HVAC system 100, its subsystems, and/or devices. Client device 368 can be a computer workstation, a client terminal, a remote or local interface, or any other type of operator interface device. Client device 368 can be a stationary terminal or a mobile device. For example, client device 368 can be a desktop computer, a computer server with an operator interface, a laptop computer, a tablet, a smartphone, a PDA, or any other type of mobile or non-mobile device. Client device 368 can communicate with BMS controller 366 and/or AHU.

Temperature Smoothing Thermostat System

Figure 4A:
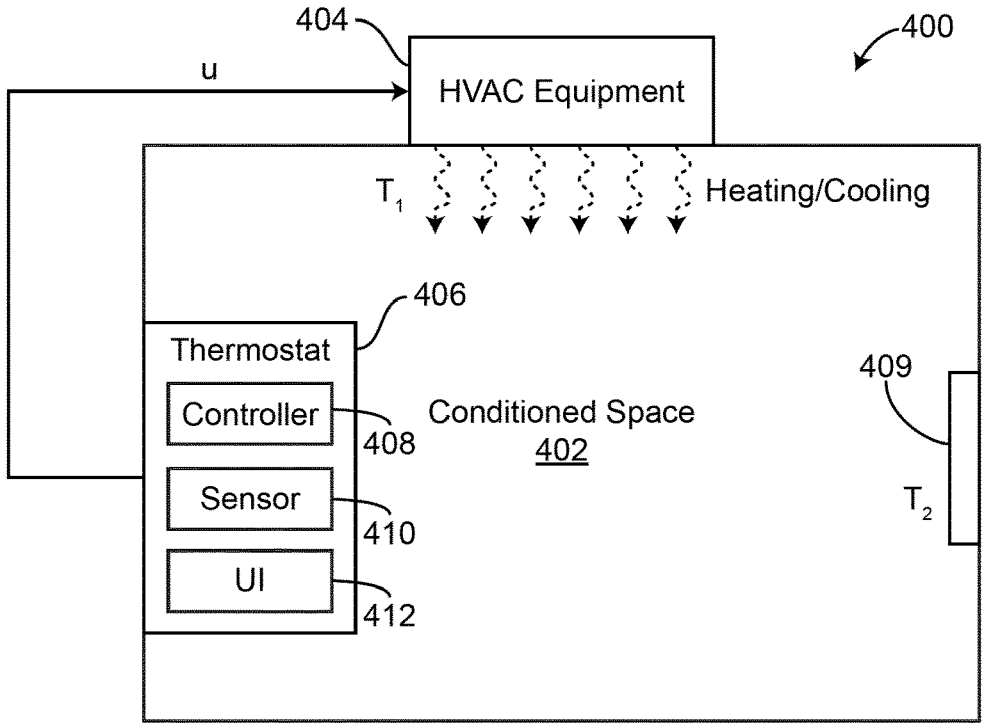
FIG. 4A is a block diagram of an on-site thermostat configured to adjust an operation of HVAC equipment for a conditioned space, according to some embodiments.
Figure 4B:
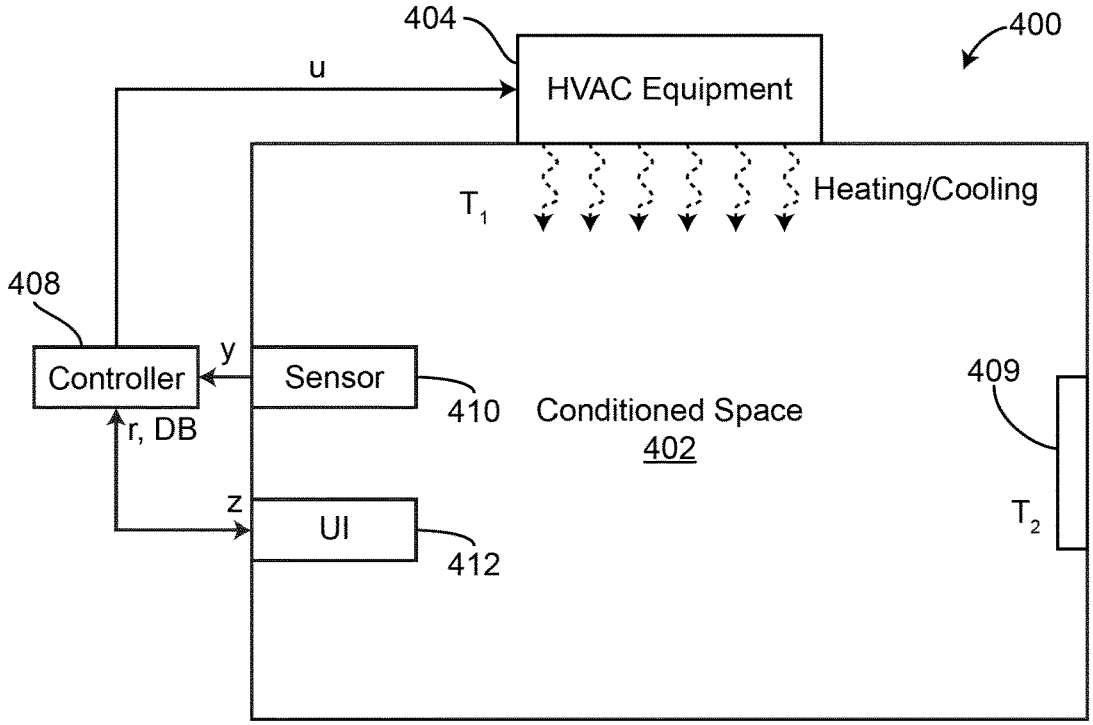
FIG. 4B is a block diagram of a controller configured to adjust an operation of HVAC equipment for a conditioned space, according to some embodiments.

Referring now to FIGS. 4A-4B, system 400 is shown, according to some embodiments. System 400 includes conditioned space 402, according to some embodiments. Conditioned space 402 may be a room, an area, a floor of a building, etc., or any other space to which heating and/or cooling is provided and monitored. System 400 includes HVAC equipment 404 configured to provide heating or cooling to conditioned space 402, according to some embodiments. HVAC equipment 404 may be configured to provide heating and/or cooling to conditioned space 402 via one or more ducts, vents, fans, etc. Conditioned space 402 may have a temperature distribution throughout various areas of conditioned space 402. For example, conditioned space 402 may have a temperature $T_1$ near HVAC equipment 404, and a temperature $T_2$ near a window or door 409. If HVAC equipment 404 is in an operating state to provide cooling to conditioned space 402, $T_2$ may be greater than $T_1$. Likewise, if HVAC equipment 404 is in an operating state to provide heating to conditioned space 402, $T_2$ may be less than $T_1$. Conditioned space 402 may have an average temperature (e.g., an average with respect to area of conditioned space 402) $T_{avg}$.

System 400 includes thermostat 406 as shown in FIG. 4A, according to some embodiments. Thermostat 406 is configured to adjust an operation of HVAC equipment 404 by providing HVAC equipment 404 with manipulated variable u, according to some embodiments. In some embodiments, manipulated variable u is a command to transition HVAC equipment 404 between an on state and an off state. In some embodiments, manipulated variable u is a command to transition HVAC equipment 404 between a cooling state, a heating state, and an off state. For example, if HVAC equipment 404 includes equipment configured to provide heating to conditioned space 402, thermostat 406 may provide the heating equipment of HVAC equipment 404 configured to provide heating to conditioned space 402 with manipulated variable $u_H$ which indicates a command to transition the heating equipment of HVAC equipment 404 between an on state (i.e., a state which causes the heating equipment to operate to provide heating to conditioned space 402) and an off state (i.e., a state which causes the heating equipment to be in-operational or to not provide heating to conditioned space 402). Likewise, if HVAC equipment 404 includes cooling equipment configured to provide cooling to conditioned space 402, thermostat 406 may be configured to provide the cooling equipment with a manipulated variable $u_C$ to transition the cooling equipment between an on state (i.e., a state which causes the cooling equipment to operate to provide cooling to conditioned space 402) and an off state (i.e., an in-operational state of the cooling equipment). In some embodiments, manipulated variable u represents either $u_H$ or $u_C$.

In some embodiments, thermostat 406 includes sensor 410 and controller 408. In some embodiments, sensor 410 is configured to measure a performance variable y of conditioned space 402. For example, sensor 410 may be a temperature sensor (e.g., a negative temperature coefficient thermistor, a resistance temperature detector, a thermocouple, a semi-conductor based temperature sensor, etc.) configured to measure a temperature of conditioned space 402. In some embodiments, sensor 410 is configured to measure a temperature of conditioned space 402 near thermostat 406. In some embodiments, sensor 410 is configured to measure the average temperature $T_{avg}$ of conditioned space 402. In some embodiments, multiple sensors 410 are disposed about conditioned space 402 and are configured to measure the temperature of conditioned space 402 in multiple locations. In some embodiments, the temperature measured by sensor 410 is the performance variable y. In some embodiments, sensor 410 is configured to measure an indoor air quality (e.g., concentration of airborne particulate in ppm), a humidity sensors configured to measure humidity of conditioned space 402, etc., or any other sensor configured to measure one or more conditions of conditioned space 402. In some embodiments, sensor 410 represents a plurality of the same type of sensors, or a plurality of various types of sensors.

Controller 408 of thermostat 406 is configured to determine values of the manipulated variable u to transition HVAC equipment 404 between various states (e.g., an on state and an off state, a cooling state and a heating state, etc.) based on the performance variable y measured by sensor 410, according to some embodiments. In some embodiments, controller 408 is configured to determine the manipulated variable u based on the performance variable y and a setpoint r. The setpoint r may indicate a desired temperature or a desired value of the performance variable y of conditioned space 402. In some embodiments, setpoint r is received via user interface 412 of thermostat 406. For example, a user may input a desired temperature of conditioned space 402 (e.g., 70 degrees Fahrenheit), and controller 408 may use the setpoint r, one or more values of the performance variable y, and a control algorithm to determine u to achieve the setpoint r for conditioned space 402.

In some embodiments, controller 408 receives the setpoint r from user interface 412. In some embodiments, controller 408 displays the performance variable y at user interface 412. In some embodiments, controller 408 is configured to determine a filtered, smoothed, or adjusted value z of performance variable y and provide the smoothed value z at user interface 412. In some embodiments, controller 408 also receives a deadband from user interface 412 which defines a maximum allowable temperature of conditioned space 402 and a minimum allowable temperature of conditioned space 402. For example, a user may input, at user interface 412, a value of setpoint r (e.g., 70 degrees Fahrenheit) and a deadband DB (+/−2 degrees Fahrenheit). In some embodiments, the deadband and the value of the setpoint r as received from user interface 412 define $y_{max}$ (e.g., $T_{max}$) and $y_{min}$(e.g., $T_{min}$), where $$y_{max} = r + \frac{DB}{2} \text{ and } y_{min} = r - \frac{DB}{2}.$$

For example, if r=70° F. and DB=2° F., then $y_{min}$=69° F. and $y_{max}$=71° F., according to some embodiments. Likewise, the user may input the value of $$\frac{DB}{2},$$

according to some embodiments.

In some embodiments, HVAC equipment 404 is oversized with respect to a required size of HVAC equipment for conditioned space 402. For example, HVAC equipment 404 may be able to provide heating and/or cooling at a rate faster than required for conditioned space 402. In some embodiments, the control algorithm used by controller 408 to determine the manipulated variable u includes constraints such as minimum on time $t_{min,on}$ and minimum off time $t_{min,off}$ for HVAC equipment 404. These constraints prevent controller 408 from rapidly changing the manipulated variable u between an on state and an off state so that HVAC equipment 404 does not undergo excessive wear from rapidly switching between the on state and the off state, according to some embodiments. While these constraints are advantageous to maximize equipment lifetime by reducing unnecessary and undesired actuator dither, if HVAC equipment 404 is oversized with respect to conditioned space 402, HVAC equipment 404 may provide heating and/or cooling to conditioned space 402 such that the performance variable y exceeds $y_{max}$ for a period of time and/or such that the performance variable y is less than $y_{min}$ for a period of time. However, the control algorithm may still be able to achieve r over a period of time (e.g., an average value y of the performance variable y may be substantially equal to r). In some embodiments, if the performance variable y is displayed to a user monitoring user interface 412, the user may mistakenly believe that system 400 is not functioning properly and may manually adjust setpoint r. This results in setpoint r being frequently adjusted, either to a value too high or a value too low, according to some embodiments. The user may not realize that system 400 is operating correctly, despite HVAC equipment 404 operating to provide heating and/or cooling to conditioned space 402 to achieve the setpoint r over a time period. If the user frequently adjusts the setpoint r this can result in customer annoyance, and can adversely affect achieving setpoint r.

In some embodiments, controller 408 determines the smoothed or filtered value z of performance variable y and displays the smoothed value z of the performance variable y via user interface 412. The smoothed value z accounts for points in time when the performance variable y is greater than $y_{max}$ or less than $y_{min}$ to reduce user annoyance and to reduce the likelihood of a customer/user adjusting the setpoint r when adjustments to the setpoint r are unnecessary. In some embodiments, the smoothed value z also smooths intermittent temperature changes in conditioned space 402. For example, if window/door 409 is opened, the performance variable y may temporarily increase or decrease, according to some embodiments. If user interface 412 is displaying a live value of the performance variable y, a user may mistakenly believe that the setpoint r should be increased or decreased to account for the temporary increase or decrease in the performance variable y, without realizing that controller 408 is configured to account for the temporary temperature changes and operate to achieve the setpoint r despite the temporary temperature changes. Advantageously, the smoothed value z reduces the likelihood of a user adjusting setpoint r based on temporary or intermittent changes in the performance variable y which the control algorithm of controller 408 is already configured to account for, according to some embodiments.

Referring now to FIG. 4B, system 400 is shown, according to some embodiments. System 400 as shown in FIG. 4B operates similarly to or the same as system 400 of FIG. 4A, however, controller 408 is positioned remotely from conditioned space 402. For example, controller 408 may be positioned at HVAC equipment 404, at a remote server, in a back room, etc. In some embodiments, controller 408 receives the performance variable y from sensor 410, the setpoint r, and the deadband DB from user interface 412. In some embodiments, controller 408 is configured to operate similarly as described above in greater detail with reference to FIG. 4A. In some embodiments, controller 408 is configured to provide the filtered value z of the performance variable y to user interface 412 for display.

Controller and Thermostat

Figure 5A:
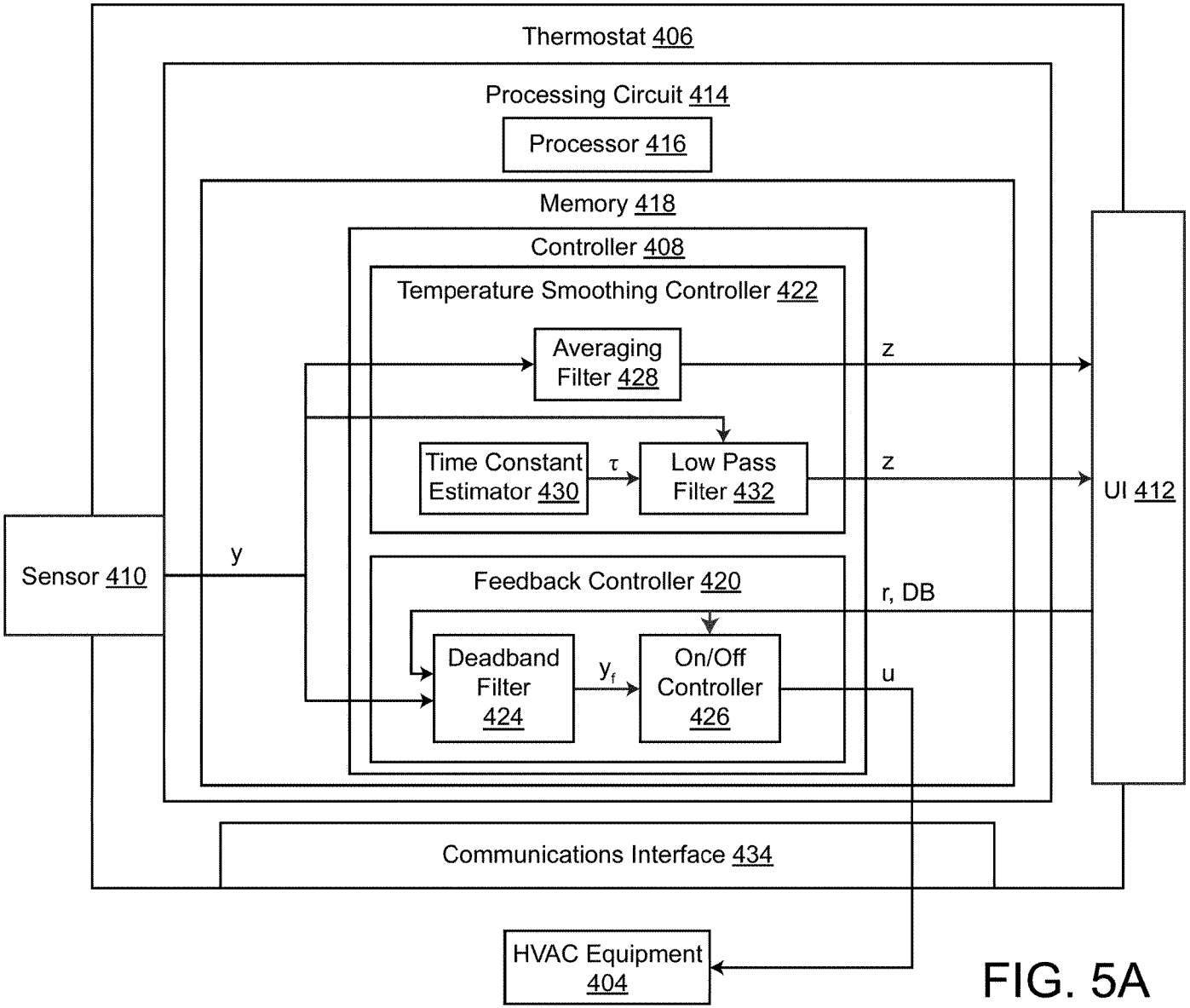
FIG. 5A is a block diagram of the thermostat of FIG. 4A, according to some embodiments.
Figure 5B:
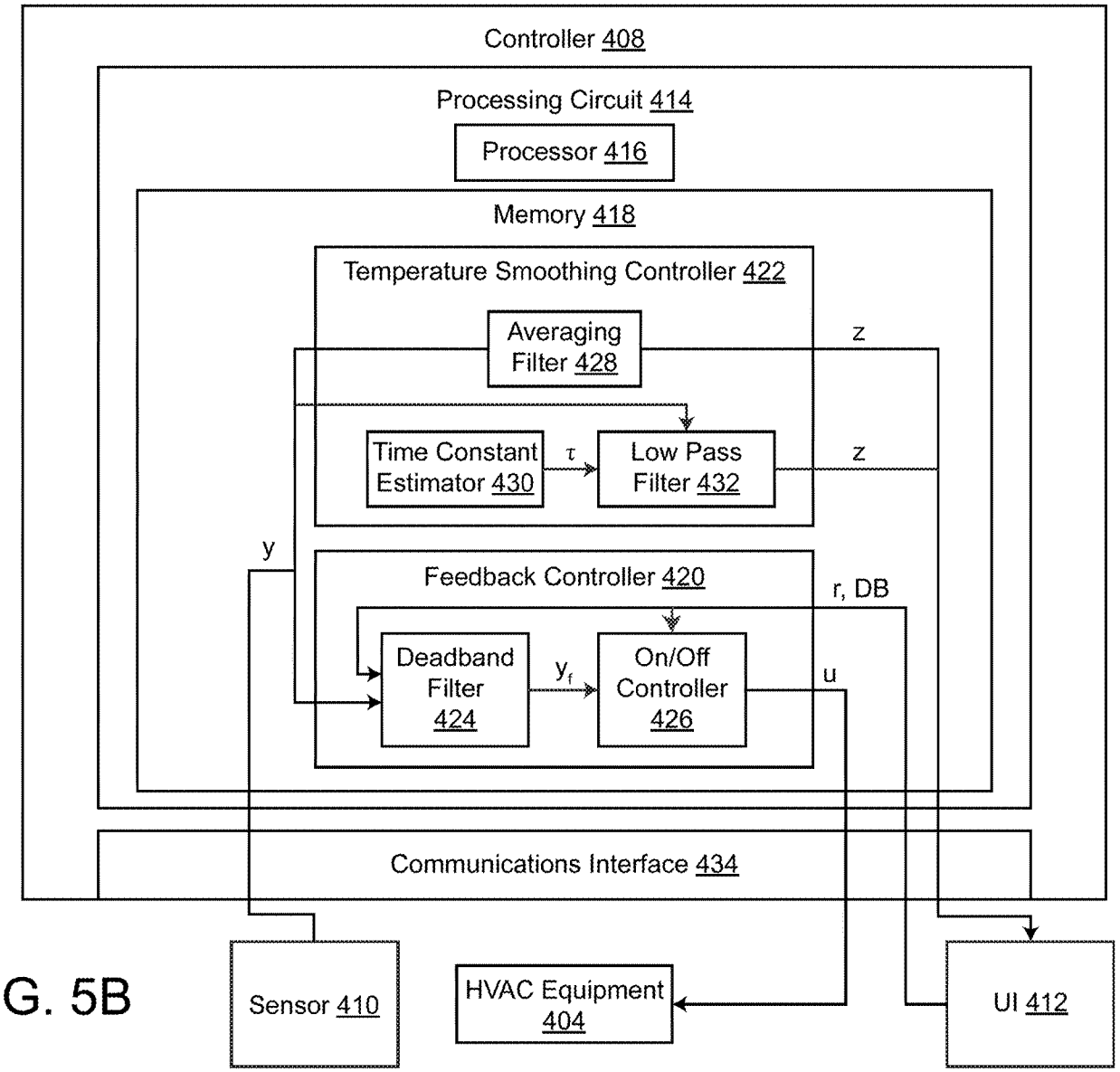
FIG. 5B is a block diagram of the controller of FIG. 4B, according to some embodiments.

Referring now to FIGS. 5A-5B, thermostat 406 and/or controller 408 are shown in greater detail, according to some embodiments. In some embodiments, FIG. 5A relates to the embodiment of system 400 as shown in FIG. 4A, and FIG. 5B relates to the embodiment of system 400 as shown in FIG. 5B. Thermostat 406 and/or controller 408 are configured to receive values of the performance variable y from sensor 410, and the setpoint r and the deadband DB from user interface 412, according to some embodiments. Thermostat 406 and/or controller 408 are configured to determine values of the manipulated variable u to operate HVAC equipment 404 to cause the performance y to achieve the setpoint r, according to some embodiments. In some embodiments, thermostat 406 and/or controller 408 are configured to determine the smoothed value z of performance variable y and provide the smoothed value z of the performance variable y to user interface 412. In some embodiments, thermostat 406 includes controller 408. In some embodiments, the functionality of thermostat 406 described in greater detail below with reference to controller 408 as shown in FIG. 5A can be implemented at a separate control device, as shown in FIG. 5B.

Referring still to FIG. 5A, thermostat 406 is shown to include a communications interface 434, according to some embodiments. Communications interface 434 can include any number of jacks, wire terminals, wire ports, wireless antennas, or other communications interfaces for communicating information and/or control signals. In some embodiments, communications interface 434 facilitates a communicable connection between thermostat 406 and HVAC equipment 404, sensor 410, and user interface 412. For example, communications interface 434 can be configured to receive an analog feedback signal (e.g., an output variable, a measured signal, a sensor output, a controlled variable) of the performance variable y from sensor 410. In some embodiments, communications interface 434 is configured to receive a digital setpoint signal of the setpoint r from user interface 412. Communications interface 434 can be a digital output (e.g., an optical digital interface) configured to provide a digital control signal (e.g., a manipulated variable, a control input) to HVAC equipment 404. In other embodiments, communications interface 434 is configured to provide an analog output signal to HVAC equipment 404. In some embodiments, communications interface 434 is configured to provide display signals to user interface 412 to display the smoothed values z of the performance variable y.

Referring still to FIG. 5A, thermostat 406 is shown to include a processing circuit 414 having a processor 416 and memory 418, according to some embodiments. Processor 416 can be a general purpose or specific purpose processor, an application specific integrated circuit (ASIC), one or more field programmable gate arrays (FPGAs), a group of processing components, or other suitable processing components. Processor 416 is configured to execute computer code or instructions stored in memory 418 or received from other computer readable media (e.g., CDROM, network storage, a remote server, etc.), according to some embodiments.

Memory 418 can include one or more devices (e.g., memory units, memory devices, storage devices, etc.) for storing data and/or computer code for completing and/or facilitating the various processes described in the present disclosure. Memory 418 can include random access memory (RAM), read-only memory (ROM), hard drive storage, temporary storage, non-volatile memory, flash memory, optical memory, or any other suitable memory for storing software objects and/or computer instructions. Memory 418 can include database components, object code components, script components, or any other type of information structure for supporting the various activities and information structures described in the present disclosure. Memory 418 can be communicably connected to processor 416 via processing circuit 414 and can include computer code for executing (e.g., by processor 416) one or more processes described herein.

Memory 418 is shown to include controller 408, including temperature smoothing controller 422 and feedback controller 420, according to some embodiments. In some embodiments, feedback controller 420 is configured to receive the performance variable y as feedback from sensor 410 and determine values of the manipulated variable u for HVAC equipment 404. In some embodiments, feedback controller 420 includes deadband filter 424 and on/off controller 426. In some embodiments, deadband filter 424 is configured to receive the setpoint r and the deadband DB from user interface 412, and the performance variable y from sensor 410. Deadband filter 424 is configured to determine a filtered value $y_f$ of the performance variable y based on the performance variable y, the setpoint r, and the deadband DB, according to some embodiments. In some embodiments, deadband filter 424 uses graph 700 as shown in FIG. 7 to filter the performance variable y to determine $y_f$.

Figure 7:
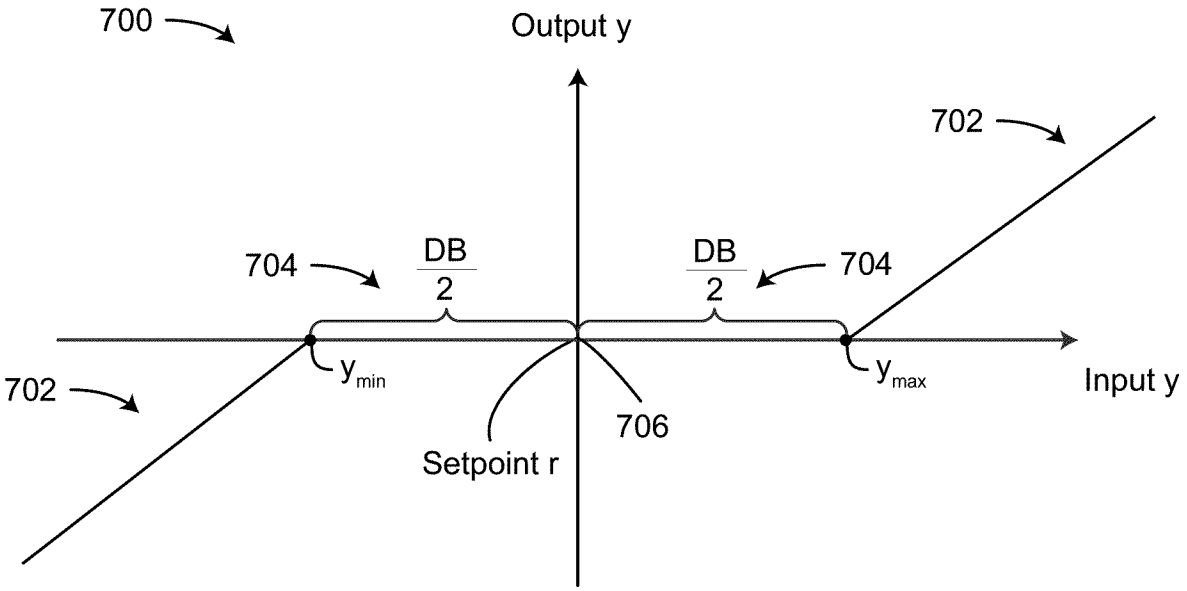
FIG. 7 is a graph of a deadband filter used by the thermostat of FIG. 5A and the controller of FIG. 5B, according to some embodiments.

Referring now to FIGS. 5A and 7, if the measurement of performance variable y is within the deadband range (i.e., between deadband upper limit and deadband lower limit;

$$r - \frac{DB}{2} \le y \le r + \frac{DB}{2}),$$

deadband filter 424 may set the filtered value $y_f$ of the performance variable y equal to the setpoint r. However, if the value of the performance variable y is outside the deadband range $$\text{i.e., } y < r - \frac{DB}{2} \text{ or } y > r + \frac{DB}{2}),$$

deadband filter 424 may add or subtract the deadband threshold $$\frac{DB}{2}$$

from the value of the performance variable y to bring the filtered value $y_f$ closer to the setpoint r. The following equation illustrates the calculation which may be performed by deadband filter 424 to generate each filtered measurement $y_f$ as a function of the corresponding raw measurement y:

$$y_f = \begin{cases} r & \text{if } |r-y| \le \frac{DB}{2} \\ r - \text{sign}(r-y)\left(|r-y| - \frac{DB}{2}\right) & \text{if } |r-y| > \frac{DB}{2} \end{cases}$$

Graph 700 illustrates the operation of deadband filter 424 as shown in FIG. 7, according to some embodiments. The horizontal axis of graph 700 represents the value of the performance variable y provided as an input to deadband filter 424, whereas the vertical axis of graph 700 represents the filtered measurement $y_f$ provided as an output of deadband filter 424, according to some embodiments. The center point 706 of graph 700 is equal to the setpoint r for measured value of the performance variable y, according to some embodiments. For example, if measured value of the performance variable y is a room temperature (e.g., a temperature of conditioned space 402), and the setpoint r for the room temperature is 70° F., the center point 706 of graph 700 may have a value of 70° F.

Graph 700 is shown to have two sections: a slope section 702 and a deadband section 704, according to some embodiments. Deadband section 704 has a range of $$\pm\frac{DB}{2}$$

on either side of the setpoint r. If the input y to deadband filter 424 falls within deadband section 704

$$\left(\text{i.e., } r - \frac{DB}{2} \le y \le r + \frac{DB}{2}\right),$$

the output $y_f$ of deadband filter 424 is equal to the setpoint r. However, if the input y to deadband filter 424 falls within slope section 702, $$\left(\text{i.e., } y < r - \frac{DB}{2} \text{ or } y > r + \frac{DB}{2}\right),$$

the output $y_f$ of deadband filter is a linear function of the input y and is shifted closer to the setpoint r by an amount equal to the deadband threshold $$\frac{DB}{2}.$$

for example, if the input y falls within slope section 702 and is less than the setpoint r, then the output $y_f$ is equal to $$y + \frac{DB}{2}.$$

However, if the input y falls within slope section 702 and is greater than the setpoint r, then the output $y_f$ is equal to $$y - \frac{DB}{2}.$$

Advantageously, deadband filter 424 operates to reduce the integrated error of the measured value of performance variable y relative to the setpoint r by establishing a deadband section 704 around the setpoint r $$\left(\text{i.e., } r \pm \frac{DB}{2}\right),$$

according to some embodiments. If the measurement y falls within deadband section 704, the filtered measurement $y_f$ is equal to the setpoint r and the error $e=r-y_f$ is equal to zero, according to some embodiments. This ensures that feedback controller 420 will not accumulate a large integrated error (e.g., $\Sigma_{i=1}^{n} e_i$) over time for persistent values of y within deadband section 704, according to some embodiments.

In some embodiments, deadband filter 424 may receive the measured values of the performance variable y transmitted by sensor 410. For example, deadband filter 424 can receive one or more of the raw measurements y extracted from a compressed data object transmitted to feedback controller 420 from sensor 410. Deadband filter 424 can process the values of the performance variable y to generate filtered measurements $y_f$ and can provide the filtered measurements $y_f$ to on/off controller 426 for use in generating a control signal of the manipulated variable u for HVAC equipment 404.

Referring again to FIG. 5A, in some embodiments, on/off controller 426 is configured to receive the filtered value(s) $y_f$ of the performance variable y to determine control signals of the manipulated variable u for HVAC equipment 404. In some embodiments, if the filtered value(s) $y_f$ of the performance variable y exceed(s) the the setpoint r on/off controller 426 determines that cooling equipment of HVAC equipment 404 should be transitioned into an on-state (e.g., u=1 or $u_c$=1) and heating equipment of HVAC equipment 404 should be in an off-state (e.g., $u_H$=0). In some embodiments, if the filtered value(s) $y_f$ of the performance variable y are less than the setpoint r as determined based on setpoint r and the value of the deadband DB $$\left(\text{i.e., } y_{min} = r - \frac{DB}{2}\right),$$

on/off controller 426 determines that cooling equipment of HVAC equipment 404 should be transitioned into an off-state (e.g., u=0, or $u_c$=0) and heating equipment of HVAC equipment 404 should be in an on-state (e.g., $u_H$=1). In some embodiments, the manipulated variable u is a discrete value (i.e., either 1 or 0) and is determined based on the value of the performance variable y exceeding or being below the maximum value of the performance variable y, $y_{max}$, and the minimum value of the performance variable y, $y_{min}$. For example, HVAC equipment 404 may be transitioned between an operational (e.g., an on) state and an in-operational (e.g., an off) state based on the value of the performance variable y or the filtered value $y_f$ of the performance variable y, where u=1 (i.e., HVAC equipment 404 is in the on-state) in response to y or $y_f$ exceeding the maximum value $y_{max}$ of the performance variable y or in response to y or $y_f$ being less than the minimum value $y_{min}$ of the performance variable y, and u=0 in response to y or $y_f$ being between the maximum value $y_{max}$ of the performance variable y and the minimum value $y_{min}$ of the performance variable y.

In some embodiments, on/off controller 426 operates according to one or more constraints that define a minimum on-time or minimum off-time for HVAC equipment 404. For example, on/off controller 426 may track an amount of time over which HVAC equipment 404 has been in the on-state or the off-state (e.g., an amount of time since manipulated variable u changed from 0 to 1 or vice versa). In some embodiments, on/off controller 426 constrains changing the manipulated variable u based on an amount of time for which HVAC equipment 404 has been in the on-state or the off-state. For example, in some embodiments, on/off controller 426 takes into account constraints which indicate a minimum amount of time between operational changes of HVAC equipment 404. In some embodiments, on/off controller 426 includes a constraint for a minimum amount of time HVAC equipment 404 must be in the on-state, and a minimum amount of time HVAC equipment 404 must be in the off-state, $t_{min,off}$. In some embodiments, if HVAC equipment 404 has not been in the on-state or the off-state for the predetermined amount of time $t_{min,on}$ or $t_{min,off}$ respectively, on/off controller 426 maintains a current value of the manipulated variable u even if $y_f$ and/or y are greater than $y_{max}$ or less than $y_{min}$. For example, if $y_f$ and/or y exceeds $y_{max}$, but an amount of time Δt elapsed since a previous change of manipulated variable u is not greater than or equal to $t_{min,off}$ (or $t_{min,on}$ if u=1), on/off controller 426 maintains the current value of u (i.e., u=0), according to some embodiments.

On/off controller 426 is configured to determine adjustments of the manipulated variable u from 1 to 0 and vice versa, according to some embodiments. In some embodiments, on/off controller 426 provides HVAC equipment 404 with a control signal corresponding to the manipulated variable. In some embodiments, HVAC equipment 404 uses the control signal to transition between the on-state and the off-state. In some embodiments, on/off controller 426 provides a discrete value of the manipulated variable u to HVAC equipment 404. In some embodiments, on/off controller 426 outputs digital control signals to HVAC equipment 404. In some embodiments, on/off controller 426 outputs analog control signals to HVAC equipment 404. In some embodiments, on/off controller 426 is configured to communicably connect with HVAC equipment 404 and provide HVAC equipment with the control signals and/or values of the manipulated variable u via communications interface 434.

Referring still to FIG. 5A, controller 408 is shown to include temperature smoothing controller 422, according to some embodiments. In some embodiments, temperature smoothing controller 422 is configured to receive values of the performance variable y and determine one or more smoothed (or filtered) values z of the performance variable y. In some embodiments, temperature smoothing controller 422 provides the smoothed value(s) z to user interface 412. In some embodiments, user interface 412 is configured to receive the smoothed value(s) z of the performance variable y and provide the smoothed value(s) z to a user. For example, user interface 412 may include a display screen configured to provide a visual, informational, etc., indication of the smoothed value(s) z of the performance variable to a user.

In some embodiments, temperature smoothing controller 422 provides the smoothed (of filtered) values z of the performance variable y to feedback controller 420. Feedback controller 420 may use the smoothed values z of the performance variable y instead of (or in addition to) the performance variable y to generate values of the manipulated variable u. In this way, feedback controller 420 can use the smoothed values z of the performance variable y to determine control signals for HVAC equipment 404. For example, deadband filter 424 may use the smoothed values z of the performance variable y instead of (or in addition to) the performance variable y to generate the filtered value $y_f$ of the smoothed values z of the performance variable y. On/off controller 426 can then use the filtered value $y_f$ of the smoothed values z of the performance variable y to generate values of the manipulated variable u to operate HVAC equipment 404. In other embodiments, temperature smoothing controller 422 provides the smoothed values z of the performance variable y directly to on/off controller 426. On/off controller 426 can use the smoothed values z of the performance variable y to generate values of the manipulated variable u for HVAC equipment 404.

Temperature smoothing controller 422 may use any smoothing filter to determine the smoothed values z based on one or more values of the performance variable y. In some embodiments, temperature smoothing controller 422 determines z based on one or more values of the performance variable y. In some embodiments, temperature smoothing controller 422 uses an averaging filter 428 to determine z based on one or more values of the performance variable y. In some embodiments, averaging filter 428 receives and collects a number of samples of the performance variable y. In some embodiments, temperature smoothing controller 422 and/or averaging filter 428 receive and collect one or more samples of the performance variable y over a predetermined time period. In some embodiments, the number of samples received and collected over the predetermined time period depends on the sampling time of temperature smoothing controller 422 as shown in the equation below:

$$n_{samples} = \frac{t_{sample}}{\Delta t}$$

where $n_{samples}$ is a number of samples of the performance variable y collected, $t_{sample}$ is a time period over which the samples of the performance variable y, and Δt is a sampling time (e.g., an amount of time between sequentially occurring samples of the performance variable y).

In some embodiments, temperature smoothing controller 422 receives and collects samples of the performance variable y over the sampling time period $t_{sample}$. In some embodiments, temperature smoothing controller 422 receives and collects a predetermined number of samples $n_{samples}$. In some embodiments, averaging filter 428 and/or low pass filter 432 use the received and collected samples of the performance variable y to determine z. In some embodiments, temperature smoothing controller 422 determines a live smoothed value z of the performance variable y based on the received and collected samples of the performance variable y over the previous time period. In some embodiments, temperature smoothing controller 422 stores the samples of the performance variable y over the previous time period in a vector $\vec{y}_{sample}$. In some embodiments, temperature smoothing controller 422 stores a rolling set of samples of the performance variable y. For example, in some embodiments, the vector $\vec{y}_{sample}$ stores samples of the performance variable y over a previous time period with respect to a present moment in time. For example, temperature smoothing controller 422 may store collected samples of the performance variable y from the previous ten seconds, the previous five seconds, the previous fifteen seconds, etc. In some embodiments, temperature smoothing controller 422 collects and stores all samples of the performance variable y since an initiation (e.g., a startup) of thermostat 406. In some embodiments, temperature smoothing controller 422 collects and stores all samples of the performance variable y since a change of the manipulated variable u.

In some embodiments, averaging filter 428 uses the equation:

$$z = \frac{\sum_{i=1}^{i=n} y_i}{n}$$

where z is the smoothed value of the performance variable y (e.g., at a present moment in time), $y_i$ is an ith element of the vector $\vec{y}_{sample}$, and n is a total number of samples of the performance variable y collected and stored over the previous time period $t_{sample}$ (i.e. $n_{samples}$). The equation shown above averages the collected and stored samples of the performance variable y over the previous time period $t_{sample}$. In some embodiments, the previous time period is the ten seconds, 30 minutes, an hour, etc., or any other predetermined amount of time. In some embodiments, the previous time period is the amount of time since a change of the manipulated variable u.

In some embodiments, averaging filter 428 uses the equation:

$$z(t) = \frac{\sum_{i=0}^{i=n} y(t - i\Delta t)}{n}$$

where z(t) is a smoothed value of the performance variable y at a present time t, Δt is the sampling time, y(t−iΔt) is a sampled value of the performance variable y at time t−Δt, and n is the number of samples of the performance variable y collected over the previous time period (e.g., $t_{sample}$).

In some embodiments, z and/or z(t) is output to user interface 412 from temperature smoothing controller 422. Advantageously, any spikes in the performance variable y may be smoothed by averaging filter 428, according to some embodiments. In some embodiments, averaging filter 428 facilitates preventing a user from mistakenly adjusting the setpoint r by taking into account temporary increases or decreases in the performance variable y (i.e., temporary increases or decreases in the temperature of conditioned space 402).

Referring still to FIG. 5A, temperature smoothing controller 422 is shown to include time constant estimator 430 and low pass filter 432, according to some embodiments. In some embodiments, temperature smoothing controller 422 uses time constant estimator 430 and low pass filter 432 instead of averaging filter 428. In some embodiments, temperature smoothing controller 422 uses both averaging filter 428 and time constant estimator 430/low pass filter 432 to determine z.

Low pass filter 432 is configured to receive samples of the performance variable y and determine smoothed/filtered values z of the performance variable y, according to some embodiments. In some embodiments, low pass filter 432 uses the equation shown below to determine z:

$$z_i = \alpha y_i + (1-\alpha) z_{i-1}$$

where $z_i$ is the filtered/smoothed value at i (e.g., at a present moment in time), α is a filtering/smoothing factor, $y_i$ is the value of the performance variable at i (e.g., at a present moment in time), $z_{i-1}$ is a previously determined filtered/smoothed value at i−1. In some embodiments, a is a value between 0 and 1. In some embodiments, low pass filter 432 removes high frequency signals to smooth/average/filter the performance variable y. In some embodiments, low pass filter 432 is configured to calculate an exponentially weighted moving average of samples of the performance variable y. In some embodiments, the exponentially weighted moving average is the smoothed/filtered value z.

In some embodiments, low pass filter 432 receives a time constant t from time constant estimator 430 The time constant t may be estimated by time constant estimator 430 using any of the techniques described in greater detail in U.S. patent application Ser. No. 15/173,284, filed Jun. 3, 2016, U.S. patent application Ser. No. 13/794,683, filed Mar. 11, 2013, now U.S. Pat. No. 9,395,708, U.S. patent application Ser. No. 15/448,179, filed Mar. 2, 2017, and/or U.S. patent application Ser. No. 15/173,295, filed Jun. 3, 2016, all of the disclosures which are incorporated by reference herein in their entireties. In some embodiments, the time constant t is a time constant of system 400. In some embodiments, temperature smoothing controller 422 determines parameters for low pass filter 432 and/or averaging filter 428 based on the time constant t. For example, a lower time constant t may indicate a faster response of system 400, which may require a higher amount of smoothing. For example, the time constant t may be used to set a cutoff frequency of low pass filter 432. If the time constant t is long, the cutoff frequency may be set to a low value since fluctuations in the signal associated with the performance variable y that occur significantly faster than a response time of system 400 may be largely due to noise in the signal and should therefore be filtered out. Likewise, if the time constant t is short and therefore the response time of system 400 is fast, the cutoff frequency of low pass filter 432 may be set to a higher value since the rapid changes of the signal associated with the performance variable y may be indicative of the response of system 400 and should therefore not be completely filtered out. In some embodiments, the higher amount of smoothing of averaging filter 428 is achieved by averaging a greater number of samples or by averaging samples over a longer previous time period. In some embodiments, the higher amount of smoothing of low pass filter 432 is achieved by increasing the smoothing factor α. In some embodiments, n (the number of samples averaged) and/or α is increased in response to the smoothed value z of the performance variable still exceeding $y_{max}$ or being less than $y_{min}$. In this way, the smoothing factor α or the number of samples n is used by temperature smoothing controller 422 to smooth the values of the performance variable y such that the smoothed values z of the performance variable y remain within the deadband upper and lower limits as determined by the setpoint r and the deadband DB.

Referring now to FIG. 5B, controller 408 is shown as a device separate from thermostat 406, according to some embodiments. Controller 408 includes temperature smoothing controller 422 and feedback controller 420, according to some embodiments. In some embodiments, controller 408 is configured to perform any of the functionality of thermostat 406 as described in greater detail above with reference to FIG. 5A. In some embodiments, controller 408 receives values of the performance variable y from sensor 410, the setpoint r and the deadband DB from user interface 412. In some embodiments, controller 408 is remotely positioned relative to conditioned space 402. Controller 408 determines values of the manipulated variable u and provides the values of the manipulated variable u (e.g., in the form of control signals) to HVAC equipment 404 to transition HVAC equipment 404 between various modes of operation (e.g., an on-state, an off-state, a cooling state, a heating state, etc.) to affect the performance variable y, according to some embodiments. Temperature smoothing controller 422 receives values of the performance variable y and uses any of the methods described above to determine one or more smoothed values z of the performance variable y and provides the smoothed values z to user interface 412, according to some embodiments. In some embodiments, controller 408 is configured to remotely (e.g., wirelessly) communicate with sensor 410, HVAC equipment 404, and user interface 412. For example, controller 408 may be positioned off-site, configured to communicate with HVAC equipment 404, sensor 410, and user interface 412. In some embodiments, controller 408 is positioned off-site and is configured to communicate with a thermostat (e.g., a thermostat similar to thermostat 406). In some embodiments, controller 408 is configured to receive the values of the performance variable y, the setpoint r, and the deadband DB from an on-site thermostat. In some embodiments, controller 408 remotely determines changes to the manipulated variable u and the smoothed/filtered values z of the performance variable y, and provides the value of the manipulated variable u and the smoothed/filtered values z of the performance variable to the on-site thermostat for use in adjusting the operation of HVAC equipment 404 and to display the smoothed/filtered values z of the performance variable y to a user.

Example Graph

Figure 6:
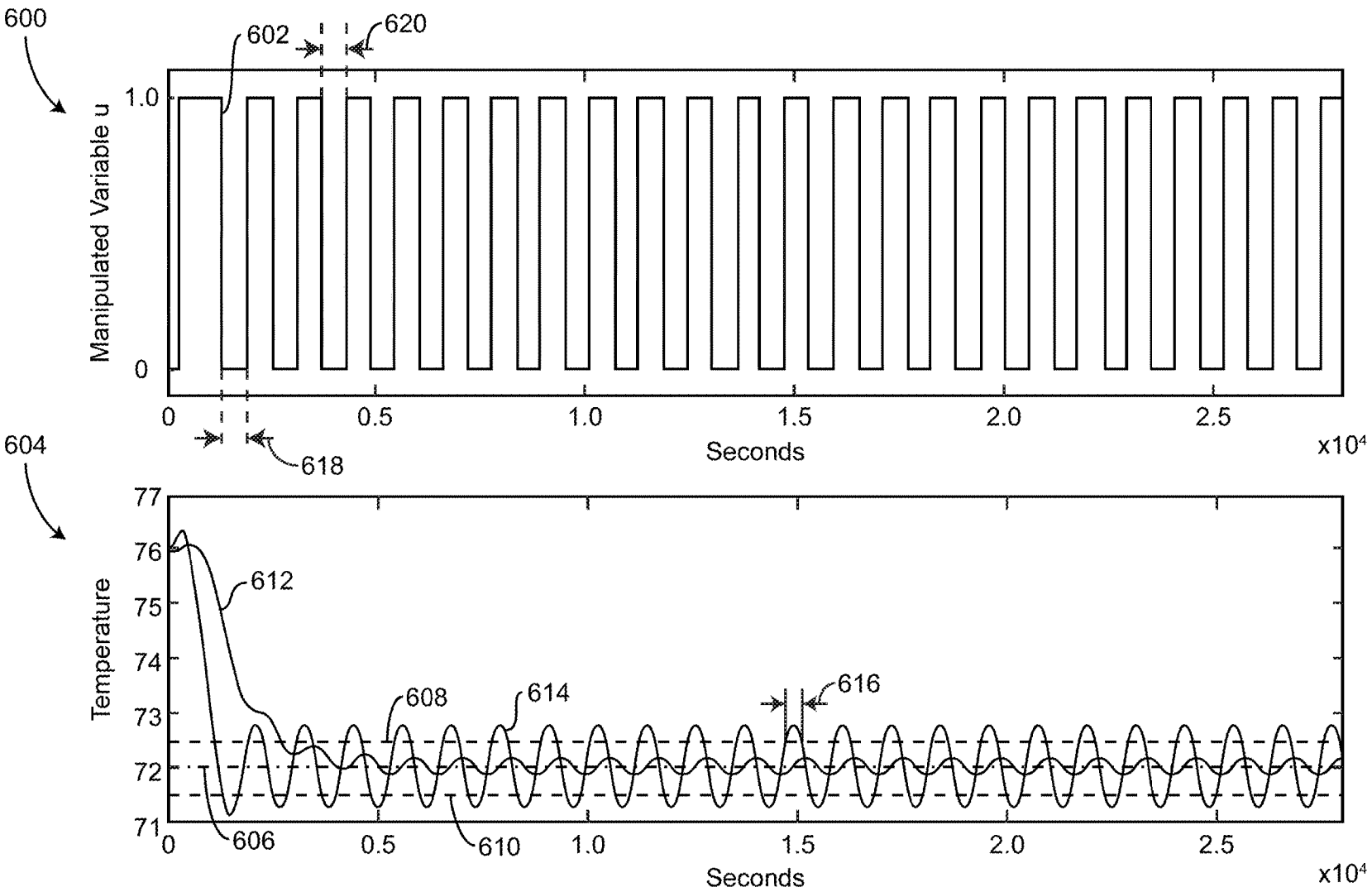
FIG. 6 is a graph of a manipulated variable of HVAC equipment with respect to time and a graph of a performance variable and a smoothed variable with respect to time, according to some embodiments.

Referring now to FIG. 6, graphs 600 and 604 illustrate changes in the manipulated variable u and temperature with respect to time, according to some embodiments. As shown in FIG. 6, the X-axis of graphs 600 and 604 is time in seconds, according to some embodiments. The Y-axis of graph 600 illustrates the discrete value of the manipulated variable u (e.g., either 0 or 1), according to some embodiments. The Y-axis of graph 604 illustrates temperatures (e.g., the performance variable y, the smoothed/filtered value z of the performance variable, etc.), according to some embodiments.

As shown by series 602 of graph 600, the manipulated variable u actuates between 1 and 0 over the time period, according to some embodiments. In some embodiments, a manipulated variable u value of 1 indicates that HVAC equipment (e.g., HVAC equipment 404) is in an operational state (e.g., an on-state). In some embodiments, a manipulated variable u value of 0 indicates that HVAC equipment (e.g., HVAC equipment 404) is in an in-operational state (e.g., an off-state).

As shown in graph 604, as the manipulated variable u changes between 0 and 1 (i.e., HVAC equipment 404 transitions between an on-state and an off-state), the temperature fluctuates with respect to time, according to some embodiments. Series 614 of graph 604 illustrates values of the performance variable y over time, according to some embodiments. Series 612 illustrates the smoothed/filtered values z of the performance variable y, according to some embodiments. Graph 604 also includes setpoint 606, upper limit 608, and lower limit 610, according to some embodiments. In some embodiments, setpoint 606 is a value of setpoint r as input by a user. In some embodiments, upper limit 608 and lower limit 610 are the upper and lower deadband limits as determined based on the setpoint r and the value of the deadband DB.

As shown in graph 604, the performance variable y regularly exceeds upper limit 608, according to some embodiments. Likewise, the performance variable y regularly goes below the lower limit 610. This may be due to the minimum on and off time constraints of HVAC equipment 404, according to some embodiments. In some embodiments, this is due to the constraints of the minimum amount of time HVAC equipment 404 must be in the on-state, $t_{min,on}$, and the minimum amount of time HVAC equipment 404 must be in the off-state, $t_{min,off}$, as used by on/off controller 426. In some embodiments, the minimum amount of time HVAC equipment 404 must be in the on-state, $t_{min,on}$, is time duration 618 as shown on graph 600. In some embodiments, the minimum amount of time HVAC equipment 404 must be in the off-state, $t_{min,off}$, is time duration 620 as shown on graph 600. As shown in graph 604, the performance variable y is regularly greater than the upper limit 608 or less than the lower limit 610 for a time duration 616, according to some embodiments. In some embodiments, during this time duration 616, a user may mistakenly adjust the setpoint r.

As shown in graph 604, the smoothed/filtered value z of the performance variable y is represented by series 612, according to some embodiments. As shown in graph 604, series 612 (the smoothed/filtered values of series 614) remains within upper limit 608 and lower limit 610, according to some embodiments. Advantageously, this removes time durations 616 where the displayed performance variable y would be outside of upper limit 608 and lower limit 610, according to some embodiments. In some embodiments, the present value of series 612 is displayed to a user via user interface 412. In some embodiments, series 614 is still used by controller 408 and/or thermostat 406 to determine control signals of the manipulated variable u for HVAC equipment 404, but the present value of series 612 is displayed to the user via user interface 412. Advantageously, this reduces the likelihood that a user will mistakenly adjust the setpoint r in response to observing time durations 616 where the displayed variable is not within upper limit 608 and lower limit 610, according to some embodiments.

Process for Control and Display of HVAC Equipment

Figure 8:
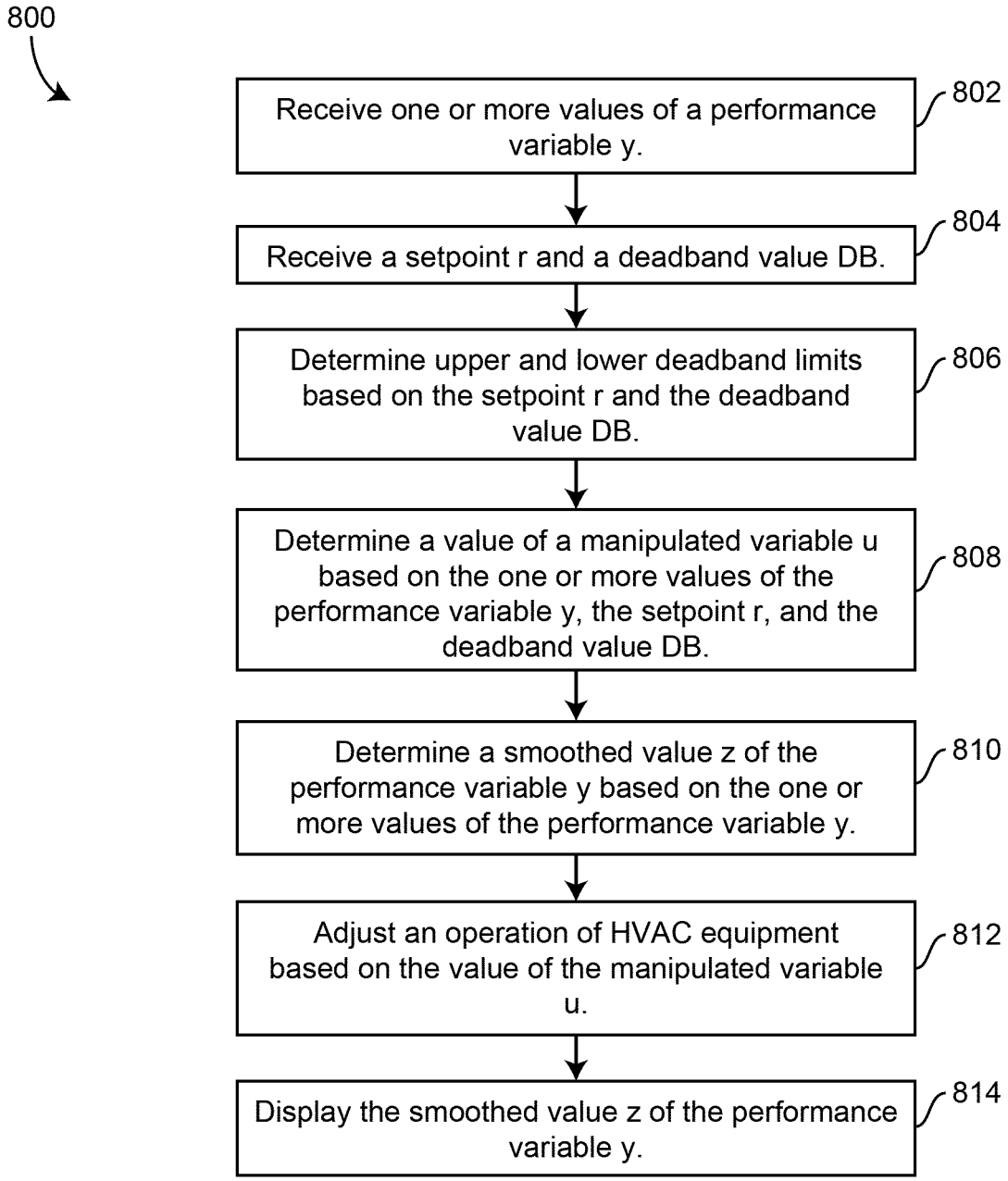
FIG. 8 is a process for controlling HVAC equipment and determining and displaying a smoothed value of a performance variable, according to some embodiments.

Referring now to FIG. 8, a process 800 for controlling HVAC equipment and displaying a performance variable is shown, according to some embodiments. In some embodiments, process 800 is performed by controller 408. In some embodiments, process 800 is performed by thermostat 406. Process 800 includes steps 802-814, according to some embodiments. In some embodiments, process 800 advantageously reduces the likelihood of a user unnecessarily adjusting the setpoint r of the thermostat by displaying a smoothed/filtered value z of the performance variable y to the user as opposed to displaying the performance variable y to the user.

Process 800 includes receiving one or more values of a performance variable y (step 802), according to some embodiments. In some embodiments, the one or more values of the performance variable y are one or more previous values of temperature as measured by sensor 410. In some embodiments, the performance variable y is a temperature of conditioned space 402. For example, the performance variable y may be a temperature of conditioned space 402 near thermostat 406, an average room temperature of conditioned space 402, etc. In some embodiments, the one or more values of the performance variable y includes a present value of the performance variable y. In some embodiments, the one or more values of the performance variable y are received by controller 408 and/or thermostat 406. In some embodiments, the one more value of the performance variable y are provided to thermostat 406 and/or controller 408 by sensor 410.

Process 800 includes receiving a setpoint r and a deadband value DB (step 804), according to some embodiments. In some embodiments, the setpoint r is a desired value of the performance variable y. In some embodiments, the setpoint r is a desired indoor air temperature of conditioned space 402. In some embodiments, the setpoint r is received by thermostat 406 and/or controller 408 from user interface 412. In some embodiments, the setpoint r is input by a user at user interface 412. In some embodiments, the setpoint r is a temperature value. In some embodiments, the deadband value DB is provided to controller 408 and/or thermostat 406 via user interface 412. In some embodiments, the deadband value DB defines a range of acceptable values of the performance variable y. In some embodiments, feedback controller 420 of controller 408 and/or thermostat 406 receives the setpoint r, and the deadband value DB. In some embodiments, a user inputs the setpoint value r and the deadband value DB.

Process 800 includes determining upper and lower deadband limits based on the setpoint r and the deadband value DB (step 804), according to some embodiments. In some embodiments, the setpoint r and the deadband value DB are used to determine minimum and maximum acceptable values of the performance variable y. In some embodiments, the setpoint r and the deadband value DB are used to determine a range of acceptable values of the performances variable y. In some embodiments, the setpoint r and the deadband value DB are used to determine $y_{min}$ and $y_{max}$. In some embodiments, the upper and lower deadband limits are determined by feedback controller 420 of thermostat 406 and/or controller 408. In some embodiments, the upper and lower deadband limits are determined by deadband filter 424 of feedback controller 420. In some embodiments, the upper and lower deadband limits are used by deadband filter 424 of feedback controller 420. In some embodiments, the upper and lower deadband limits are used by deadband filter 424 to determine $y_f$.

Process 800 includes determining a value of a manipulated variable u based on the one or more values of the performance variable y, the setpoint r, and the deadband value DB (step 808), according to some embodiments. In some embodiments, step 808 includes determining values of the manipulated variable u using the upper and lower deadband limits as determines in step 806. In some embodiments, step 808 is performed by feedback controller 420. In some embodiments, step 808 incudes determining $y_f$ by passing values of the performance variable y through deadband filter 424. In some embodiments, on/off controller 426 performs step 808 to determine values of the manipulated variable u. In some embodiments, on/off controller 426 determines the values of the manipulated variable u using $y_f$ as determined based on the setpoint r, the deadband value DB, and the one or more values of the performance variable y.

Process 800 includes determining a smoothed value z of the performance variable y based on the one or more values of the performance variable y (step 810), according to some embodiments. In some embodiments, step 810 is performed by temperature smoothing controller 422. In some embodiments, step 810 includes passing one or more values of the performance variable y through an averaging filter (e.g., averaging filter 428) to determine the smoothed value z of the performance variable y. In some embodiments, step 810 includes passing one or more values of the performance variable y through a low pass filter (e.g., low pass filter 432) to determine the smoothed value z of the performance variable y. In some embodiments, the low pass filter (e.g., low pass filter 432) uses a smoothing factor $\alpha$. In some embodiments, the smoothing factor $\alpha$ is determined based on a time constant estimate of a system. In some embodiments, the time constant estimate is determined by time constant estimator 430 and used to determine the smoothing factor $\alpha$ of low pass filter 432. In some embodiments, the smoothed value z of the performance variable y is an average value of multiple previous values of the performance variable y. In some embodiments, the smoothed value z of the performance variable y is an exponentially weighted moving average of one or more values (e.g., previous values) of the performance variable y. In some embodiments, the smoothed value z of the performance variable y accounts for temporary changes in the performance variable y. In some embodiments, the smoothed value z of the performance variable y is smoothed such that z remains within the upper and lower deadband values.

Process 800 includes adjusting an operation of HVAC equipment based on the value of the manipulated variable u (step 812), according to some embodiments. In some embodiments, step 812 is performed by feedback controller 420. In some embodiments, step 812 includes providing the value of the manipulated variable u to HVAC equipment 404. In some embodiments, the value of the manipulated variable u is a discrete value indicating in which state of operation HVAC equipment 404 should operate. In some embodiments, the value of the manipulated variable u is a value of 1 or 0. In some embodiments, on/off controller 426 is configured to perform step 812. In some embodiments, on/off controller 426 is configured to transition HVAC equipment 404 between various modes of operation by providing HVAC equipment 404 with a value of the manipulated variable u. In some embodiments, on/off controller 426 performs step 812 but takes into account an amount of elapsed time since a previous mode transition of the HVAC equipment (e.g., HVAC equipment 404). In some embodiments, on/off controller 426 is configured to maintain a current operational status of HVAC equipment 404 in response to the amount of elapsed time since the previous mode transition being less than a predetermined threshold value (e.g., a minimum on time, a minimum off time, etc.).

Process 800 includes displaying the smoothed value z of the performance variable y (step 814), according to some embodiments. In some embodiments, displaying the smoothed value z of the performance variable y includes causing user interface 412 to display the smoothed value z. In some embodiments, step 814 is performed by user interface 412. In some embodiments, step 814 includes providing a current smoothed value z of the performance variable to a user.

Process 900, thermostat 406, and/or controller 408 provide several advantages particularly for a system with oversized HVAC equipment, according to some embodiments. in some embodiments, the oversized HVAC equipment can maintain an average a setpoint value over a time period, but due to constraints on the minimum on and off time of the HVAC equipment, may produce large swings in the performance variable y which may lead a user to believe that the system is not functioning properly and/or that the setpoint needs to be adjusted (e.g., increased or decreased). This is undesirable since it leads to user annoyance and frequent and unnecessary changes of the setpoint r, according to some embodiments. However, displaying the smoothed value z of the performance variable y instead of a live value of the performance variable y reduces the likelihood that a customer will unnecessarily adjust the setpoint r. This can improve efficiency of the system and the HVAC equipment, allowing the system to operate efficiently without continual setpoint changes, according to some embodiments. Advantageously, displaying the smoothed value z of the performance variable y accounts for temporary temperature changes such as opening a door or a window, according to some embodiments. Displaying the smoothed value z also reduces the likelihood that a user would unnecessarily adjust the setpoint r in response to a temporary temperature change (e.g., opening a door or a window), according to some embodiments.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can include RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A thermostat for a conditioned space, the thermostat comprising:

a sensor configured to measure a value of a performance variable of the conditioned space;

a user interface configured to receive a setpoint value from a user and display information to the user; and a controller configured to:

receive one or more measured values of the performance variable from the sensor over a time period;

store the one or more measured values of the performance variable;

receive the setpoint value from the user interface;

determine a value of a manipulated variable based on the setpoint value and the one or more measured values of the performance variable;

adjust an operation of HVAC equipment that operate to affect the conditioned space based on the value of the manipulated variable;

determine a smoothed value of the performance variable based on the one or more measured values of the performance variable; and cause the user interface to display the smoothed value of the performance variable.

2. The thermostat of claim 1, wherein the smoothed value of the performance variable is an average of the one or more values of the performance variable collected over the time period or an exponentially weighted moving average of the one or more values of the performance variable collected over the time period.

3. The thermostat of claim 1, wherein the controller is configured to pass the one or more measured values of the performance variable from the sensor through a filter and determine the smoothed value of the performance variable as an output of the filter.

4. The thermostat of claim 3, wherein the filter has a smoothing value, wherein the smoothing value is determined based on a time constant of an HVAC system of the thermostat.

5. The thermostat of claim 1, wherein the controller is configured to maintain a current value of the manipulated variable in response to an amount of time since a previous change of the manipulated variable being less than a predetermined threshold.

6. The thermostat of claim 1, wherein the user interface is configured to receive a deadband value from the user and the controller is configured to:

receive the deadband value from the user interface; and determine the value of the manipulated variable based on the setpoint value, the deadband value, and the one or more values of the performance variable.

7. A temperature control system for a conditioned space, the system comprising:

HVAC equipment that operates to affect a temperature of the conditioned space, wherein the HVAC equipment is configured to operate in an on-state and an off-state;

a sensor configured to measure the temperature of the conditioned space;

a thermostat configured to:

receive and store multiple temperature measurements of the temperature of the conditioned space from the sensor;

determine a smoothed temperature value based on the multiple temperature measurements, wherein the smoothed temperature value accounts for temporary temperature changes of the conditioned space;

operate the HVAC equipment in the on-state or the off-state to affect the temperature of the conditioned space based on a temperature setpoint, and the temperature of the conditioned space; and cause a user interface to display the smoothed temperature value.

8. The system of claim 7, wherein the smoothed temperature value is an average of the multiple temperature measurements or an exponentially weighted moving average of the multiple temperature measurements, wherein the multiple temperature measurements are collected over a previous time interval.

9. The system of claim 7, wherein the thermostat is configured to pass the multiple temperature measurements of the temperature of the conditioned space through a low pass filter to determine the smoothed temperature value.

10. The system of claim 9, wherein the low pass filter has a smoothing factor, wherein the smoothing factor is determined based on a time constant of the system.

11. The system of claim 7, wherein the thermostat is configured to operate the HVAC equipment in the on-state or the off-state to affect the temperature of the conditioned space based on the temperature setpoint, the temperature of the conditioned space, and a deadband value.

12. The system of claim 7, wherein the thermostat is configured to maintain a current operational state of the HVAC equipment in response to an amount of time since a previous operational state change of the HVAC equipment being less than a predetermined threshold.

13. A method for adjusting an operation of HVAC equipment and determining a smoothed performance variable value, the method comprising:

receiving a setpoint value of a performance variable of a conditioned space;

measuring one or more values of the performance variable of the conditioned space;

determining a value of a manipulated variable based on the one or more measured values of the performance variable and the setpoint value;

transitioning the HVAC equipment between an on state and an off state based on the value of the manipulated variable;

determining a smoothed value of the performance variable based on the one or more measured values of the performance variable; and displaying the smoothed value of the performance variable to a user.

14. The method of claim 13, wherein the smoothed value mitigates an effect of a size of the HVAC equipment with respect to a size of the conditioned space.

15. The method of claim 13, wherein determining the smoothed value further comprises determining an average or an exponentially weighted moving average of a plurality of values of the performance variable of the conditioned space.

16. The method of claim 15, wherein the plurality of values of the performance variable of the conditioned space are sampled at a plurality of times.

17. The method of claim 13, wherein the method further comprises:

receiving a deadband value of the performance variable of the conditioned space; and determining the value of the manipulated variable based on the one or more measured values of the performance variable, the setpoint value, and the deadband value.

18. The method of claim 13, wherein determining the smoothed value further comprises passing the one or more values of the performance variable through a low pass filter.

19. The method of claim 18, wherein the low pass filter comprises a smoothing factor.

20. The method of claim 19, wherein the smoothing factor is configured to smooth the one or more values of the performance variable such that the smoothed value of the performance variable does not exceed a maximum deadband value, wherein the maximum deadband value is determined based on the setpoint value and a deadband value.

* * * * *